United States Patent [19]

Hachisuga et al.

[11] Patent Number: 4,586,834

[45] Date of Patent: May 6, 1986

[54] TRANSFER APPARATUS FOR MONOCHROMATIC OR MULTI-COLOR PRINTING

[75] Inventors: Takaaki Hachisuga, Yokohama; Tomohiko Takahashi, Tokyo; Koji Kagaya, Kawasaki; Masayoshi Nagashima, Chigasaki, all of Japan

[73] Assignee: Kabushiki Kaisha Toshiba, Kawasaki, Japan

[21] Appl. No.: 654,664

[22] Filed: Sep. 26, 1984

[30] Foreign Application Priority Data

Sep. 30, 1983 [JP] Japan ..... 58-182786

[51] Int. Cl.[4] ..... B41J 3/02; B41J 3/20

[52] U.S. Cl. ..... 400/120; 346/76 PH; 400/240.3

[58] Field of Search ..... 400/120, 240.3, 240.4, 400/249, 175, 703; 346/76 PH

[56] References Cited

U.S. PATENT DOCUMENTS

| | | | |
|---|---|---|---|
| 4,440,977 | 4/1984 | Pao | 400/120 X |
| 4,505,603 | 3/1985 | Yana | 400/240.3 X |
| 4,511,902 | 4/1985 | Nagashima | 400/120 X |
| 4,518,270 | 5/1985 | Hendrischk | 400/240.4 |

FOREIGN PATENT DOCUMENTS

| | | | |
|---|---|---|---|
| 76275 | 5/1983 | Japan | 400/240.4 |

OTHER PUBLICATIONS

*IBM Tech. Disc. Bulletin*, by J. M. Cooper, vol. 19, No. 11, Apr. 1977, p. 4242.

*IBM Tech. Disc. Bulletin*, by A. K. Cook, vol. 18, No. 5, Oct. 1975, p. 1304.

*IBM Tech. Disc. Bulletin*, by G. N. Baker, vol. 22, No. 7, Dec. 1979, pp. 2633–2635.

*Primary Examiner*—Paul T. Sewell

*Attorney, Agent, or Firm*—Cushman, Darby & Cushman

[57] ABSTRACT

According to the present invention, a transfer medium is set to be fed. Transfer materials are set to be selectively fed in such a manner that each transfer material has a monochromatic color agent and an identification code assigned thereto, or a plurality of color agents and identification codes assigned thereto. A first feeding means feeds the transfer medium, while a second feeding means feeds the transfer material. A transfer portion transfers a color agent of the transfer material fed by the second feeding means to a transfer medium fed by the first feeding means in accordance with printing data. A detecting means detects the identification code of the transfer material. A controlling means discriminates the type of transfer material in accordance with the identification code detected by the detecting means. The controlling means changes the printing mode in accordance with this discrimination result. Therefore, the feeding operations of the first and second feeding means and the transfer operation of the transfer portion are controlled in accordance with the selected printing mode.

8 Claims, 45 Drawing Figures

FIG. 17
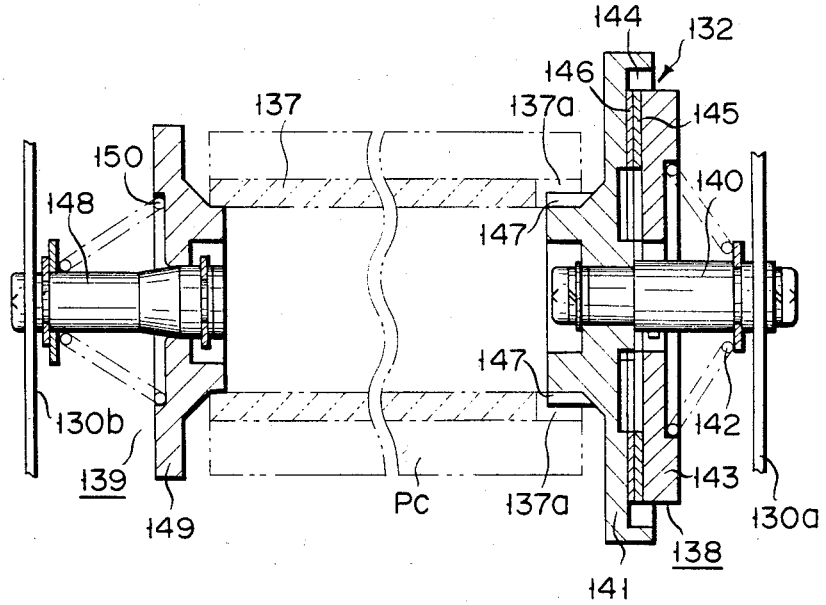
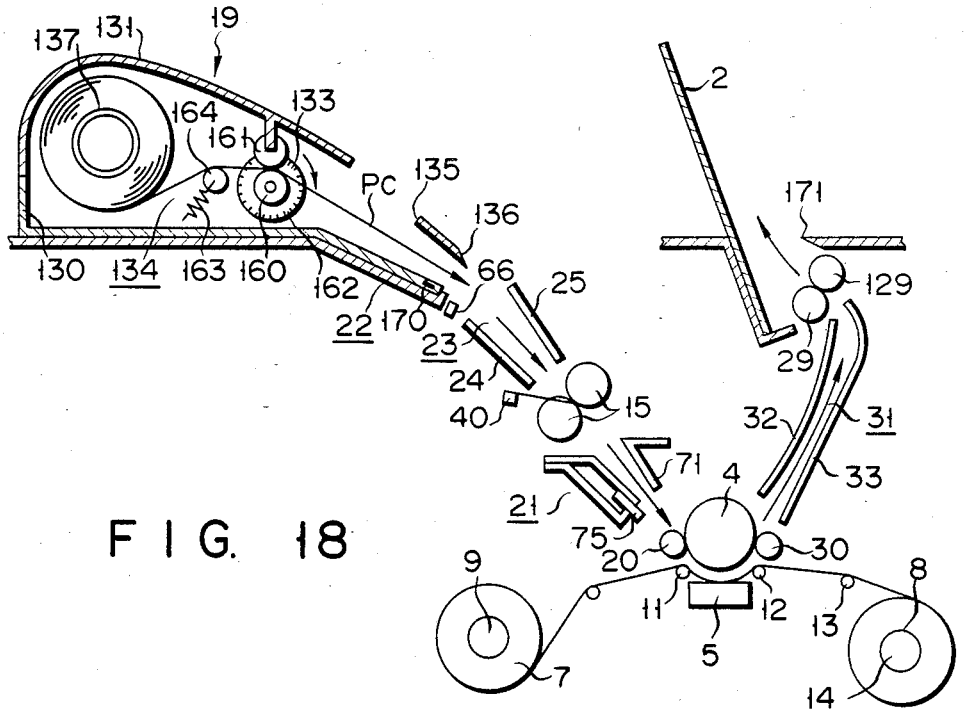
FIG. 18

FIG. 21
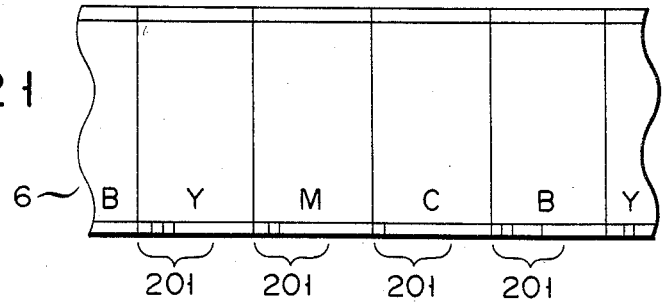
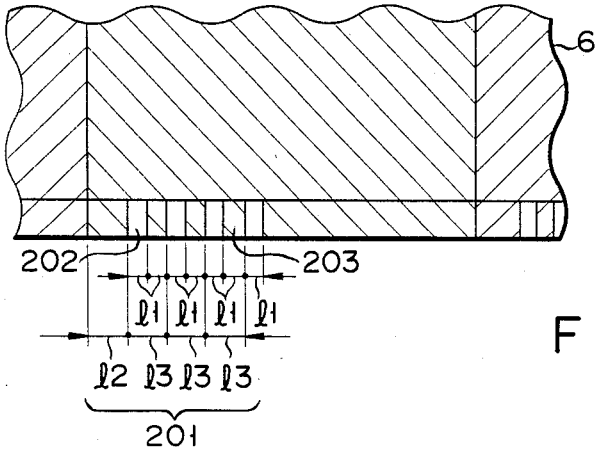
FIG. 22
FIG. 24
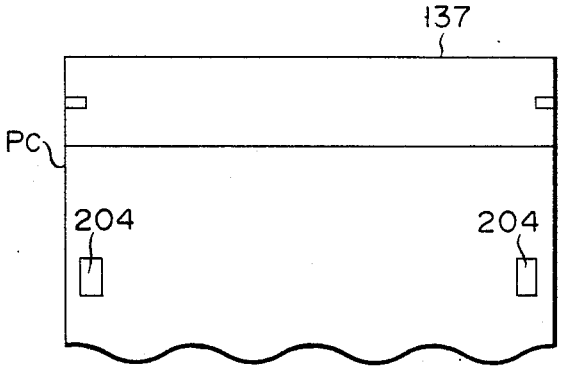

FIG. 26(a)
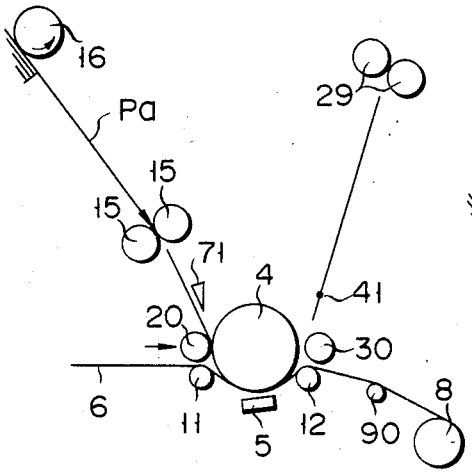
FIG. 26(b)
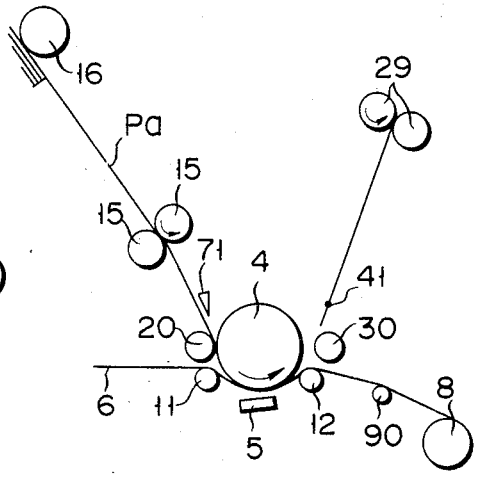
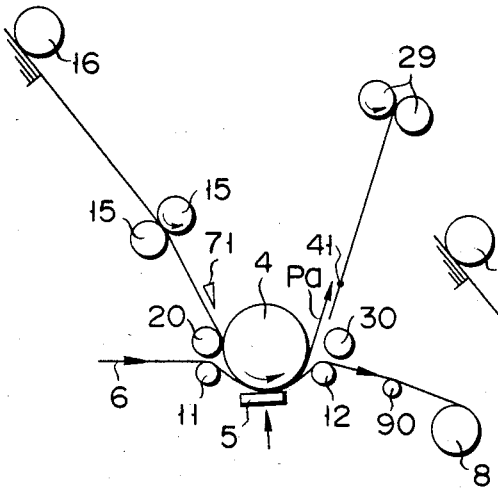
FIG. 26(c)
FIG. 26(d)
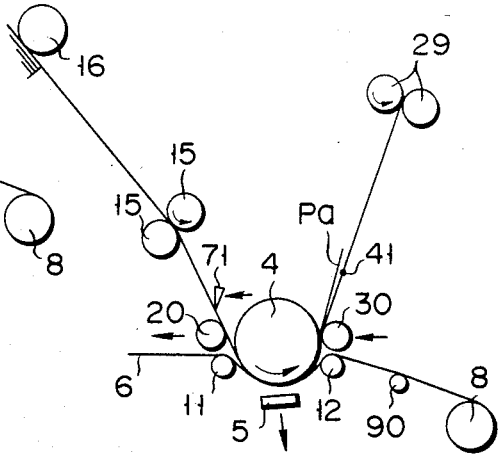

FIG. 26(e)
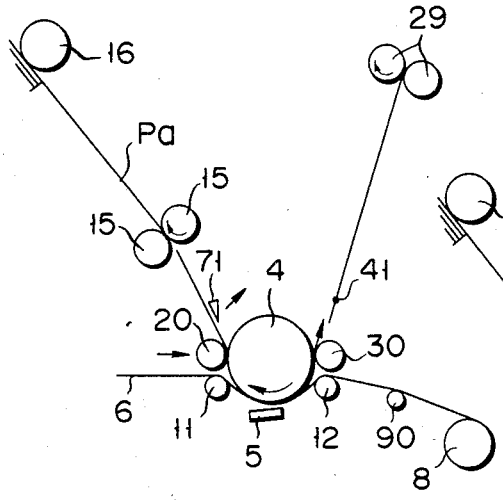
FIG. 26(f)
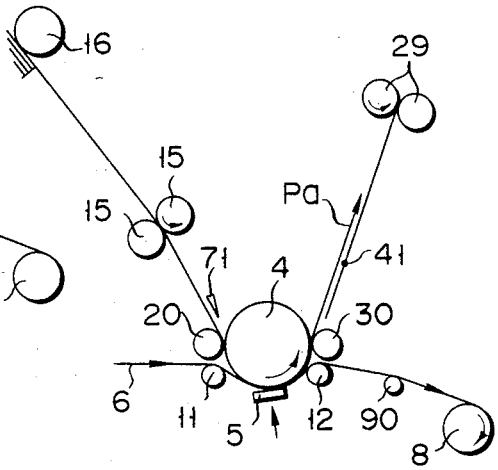
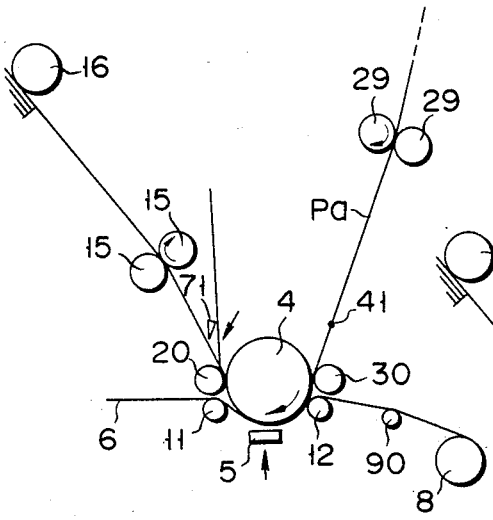
FIG. 26(g)
FIG. 26(h)
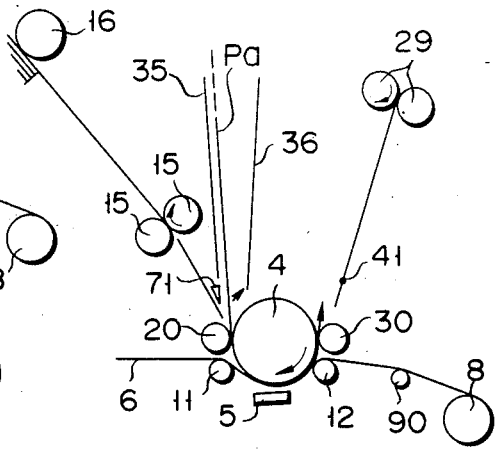

TRANSFER APPARATUS FOR MONOCHROMATIC OR MULTI-COLOR PRINTING

BACKGROUND OF THE INVENTION

This invention relates generally to a printing apparatus and, more particularly, to an improvement in a thermal transfer printing apparatus wherein monochromatic or multi-color printing can be easily performed.

A conventional printing apparatus of this type uses a monochromatic transfer material (ribbon) with a single color agent (ink) to perform printing. However, the variety of applications is limited when such a single color agent is used. In order to overcome this inconvenience, a plurality of ribbons having different color agents may be used to perform multi-color printing. However, a complicated control mechanism for switching the feed control of the ribbons in accordance with the kind of ribbon and feed control of a transfer medium (paper) is then needed. These control operations cannot be properly performed in accordance with conventional techniques.

SUMMARY OF THE INVENTION

It is, therefore, an object of the present invention to provide a new and improved printing apparatus in which the kind of transfer material is automatically discriminated to change a printing mode, thereby performing monochromatic or multi-color printing by using a monochromatic or multi-color transfer material and hence improving operability and performance.

According to the present invention, a transfer medium is set to be fed. Transfer materials are set to be selectively fed in such a manner that each transfer material has a monochromatic color agent and an identification code assigned thereto, or a plurality of color agents and identification codes assigned thereto. A first feeding means feeds the transfer medium, while a second feeding means feeds the transfer material. A transfer portion transfers a color agent of the transfer material fed by the second feeding means to a transfer medium fed by the first feeding means in accordance with printing data. A detecting means detects the identification code of the transfer material. A controlling means discriminates the kind of transfer material in accordance with the identification code detected by the detecting means. The controlling means changes the printing mode in accordance with this discrimination result. Therefore, the feeding operations of the first and second feeding means and the transfer operation of the transfer portion are controlled in accordance with the selected printing mode.

According to the configuration described above, the kind of transfer material is automatically discriminated or determined by changing the printing mode. By using the monochromatic or multi-color transfer material, monochromatic or multi-color printing can be performed, thereby improving operability and performance.

BRIEF DESCRIPTION OF THE DRAWINGS

The present invention can be understood by reference to the accompanying drawings, in which:

FIG. 17 is a sectional view showing a roll paper core holder included in the paper roll cassette shown in FIG. 16;

FIG. 18 is a representation for explaining the loading state of the paper roll cassette;

FIG. 21 is a plan view showing an example of a thermal transfer ribbon;

FIG. 22 is a plan view for explaining a bar code printed on the thermal transfer ribbon shown in FIG. 21;

FIG. 24 is a plan view for explaining a terminal end of the paper roll;

FIGS. 26(*a*) to 26(*h*) are respectively representations for explaining the respective components corresponding to the flow chart of FIG. 25;

DETAILED DESCRIPTION OF THE PREFERRED EMBODIMENT

Figure 1:
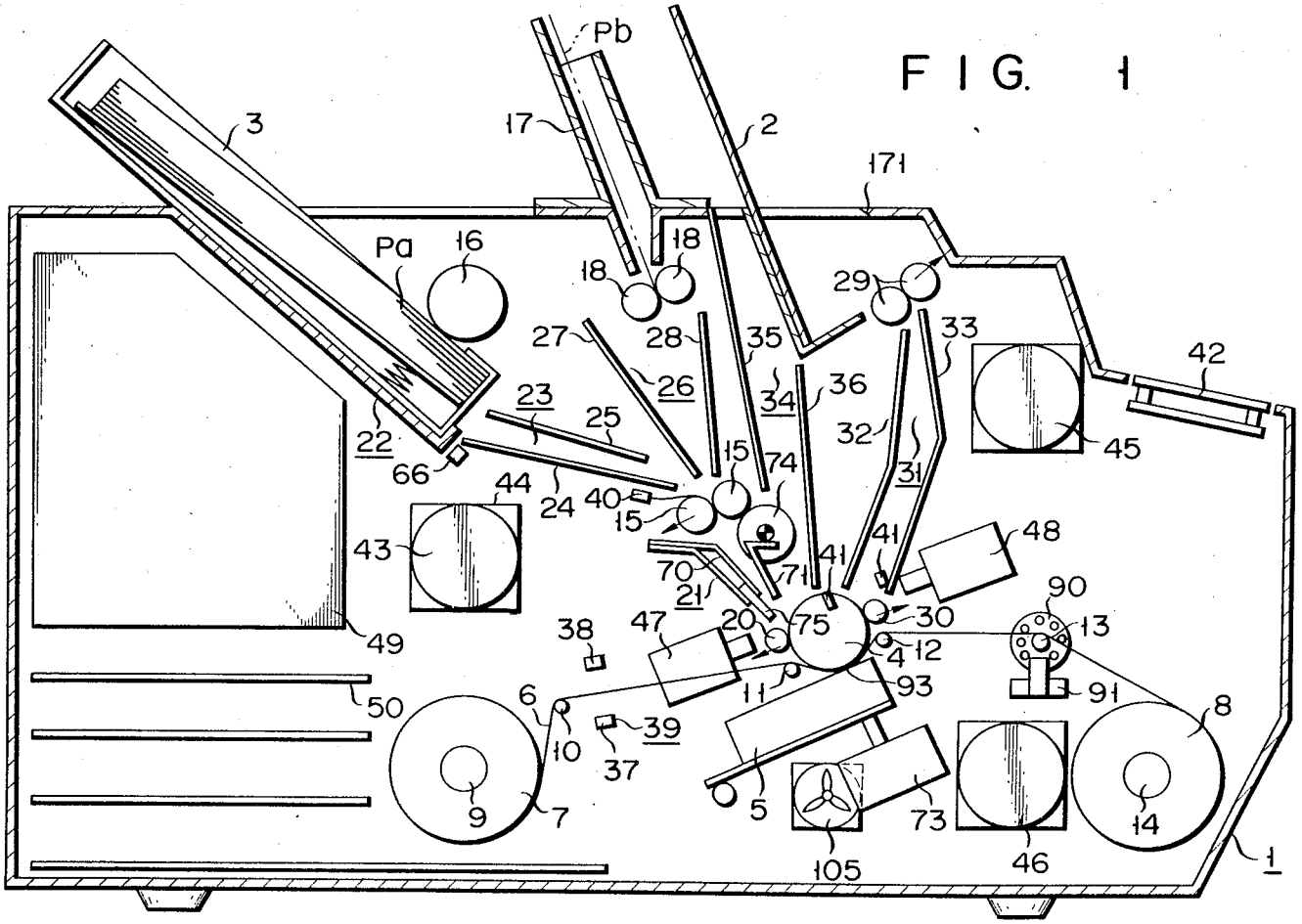
FIG. 1 is a longitudinal sectional view schematically showing the overall configuration of a printing apparatus according to an embodiment of the present invention.

The present invention will be described in detail with reference to a preferred embodiment in conjunction with the accompanying drawings. FIG. 1 schematically shows the overall configuration of a thermal transfer printing apparatus. Reference numeral 1 denotes a housing. A discharge tray 2 is arranged at the upper surface portion of the housing 1. A paper cassette 3 is attached behind the discharge tray 2. A platen roller 4 is arranged immediately below the loading portion of the discharge tray 2 in the housing 1. A thermal head 5 is arranged under the platen roller 4 and has a line-dot heating section (not shown) aligned along the axial direction of the platen roller 4.

Figure 2:
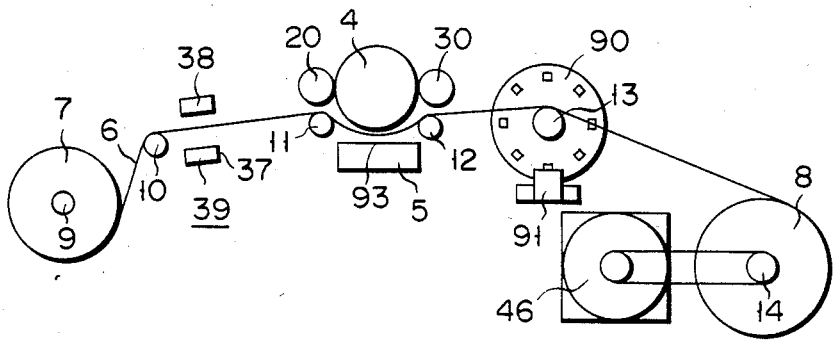
FIGS. 2 and 3 are respectively representations for explaining the construction of the main part of the apparatus in FIG. 1.

As shown in FIG. 2, a ribbon supply reel 7, which holds a roll-like thermal transfer ribbon 6 as a transfer material having a monochromatic color agent and an identification code corresponding thereto or a plurality of color agents and identification codes corresponding thereto, and a ribbon take-up reel 8, which sequentially takes up the thermal transfer ribbon 6 fed from the ribbon supply reel 7, are arranged at two sides of the thermal head 5 in the housing 1.

The thermal transfer ribbon 6 wound around a roll or reel shaft 9 in the ribbon supply reel 7 is sequentially looped around first and second ribbon guides 10 and 11 and is guided to a space between the platen roller 4 and the thermal head 5. The ribbon 6 is then abruptly bent and separated from the platen roller 4 through a third ribbon guide 12 and is looped around a fourth ribbon guide 13. Finally, the ribbon 6 is taken up by a take-up reel shaft 14.

Figure 3:
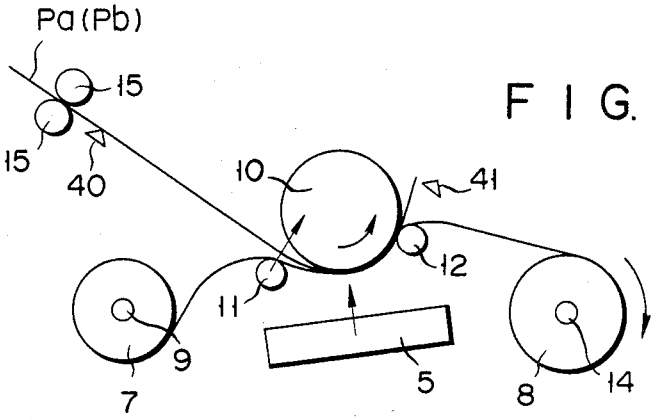

On the other hand, a pair of aligning rollers 15 are disposed at the upper rear side of the platen 4, as shown in FIG. 3. A paper sheet Pa as the transfer medium (printing paper) supplied from the paper cassette 3 through a paper feed roller 16, or a paper sheet Pb as the transfer medium inserted from a manual tray 17 and fed through manual paper feed rollers 18, or a paper roll Pc fed from a roll paper cassette 19 (FIG. 16) interchangeable with the sheet paper cassette 3 is supplied to a space between the platen roller 4 and the paper feed pinch roller 20.

A braking means 21 is arranged between the pair of aligning rollers 15 and the platen roller 4. First and second guide plates 24 and 25 are arranged between the aligning rollers 15 and a cassette loading portion 22 for loading the sheet or paper roll cassette 3 or 19 so as to form a paper guide path 23 for guiding the sheet or paper roll Pa or Pc. Similarly, third and fourth guide plates 27 and 28 are arranged between the manual paper feed rollers 18 and the aligning rollers 15 to form a manual paper feed path 26 for guiding the manually fed paper sheet Pb.

In addition, fifth and sixth guide plates 32 and 33 are arranged at a lower position corresponding to a pair of discharge rollers 29 disposed below the discharge tray 2 so as to form a discharge paper guide path 31 for guiding the paper Pa, Pb or Pc discharged between the platen roller 4 and a pinch roller 30 brought into rolling contact therewith. A return paper guide path 34 is formed between the discharge paper guide path 31 and the manual paper guide path 26 to guide the paper sheet Pa or Pb discharged from a space between the pinch roller 20 and the platen roller 4 to a space between the discharge tray 2 and the manual feed tray 17. The return guide path 34 is formed by opposing surfaces of seventh and eighth guide plates 35 and 36.

A ribbon detector 39 consists of a light-emitting element 37 and a light-receiving element 38, which are respectively disposed at the upper and lower sides of the upstream portion of a ribbon path. A paper detector (a paper feed sensor) 40 is arranged in the vicinity of the aligning rollers 15, and a paper leading end detector 41 is arranged in the vicinity of the pinch roller 30.

Referring to FIG. 1, reference numeral 42 denotes a display/input section; 43, a stepping motor as a main driving source; 44, a paper feed stepping motor; 45, a manual feed stepping motor; and 46, a ribbon take-up stepping motor. Reference numerals 47 and 48 denote plunger type solenoids for bringing the paper feed pinch roller 20 and the paper discharge pinch roller 30 into contact with or separating them from the platen roller 4. Reference numeral 49 denotes a power source; and 50, a control section.

Figure 4:
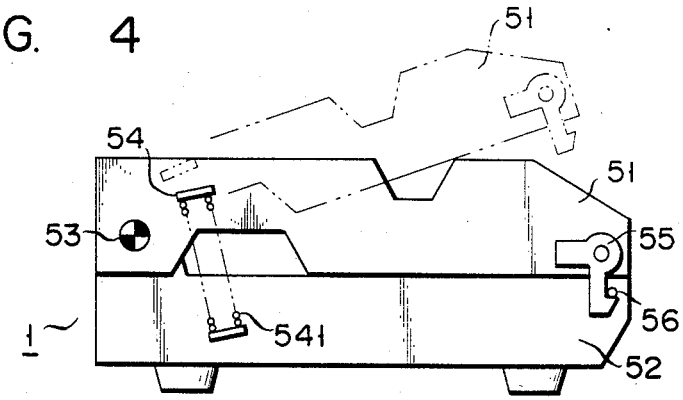
FIG. 4 is a schematic front view showing the opening/closing operation of an upper base assembly.

As shown in FIG. 4, the housing 1 consists of an upper base assembly 51 and a lower base assembly 52 which are pivotally coupled about a pivot shaft 53. The upper and lower base assemblies 51 and 52 are coupled by a support mechanism 54 consisting of a guide rod (not shown) and a compression spring 541. As a result, the upper base assembly 51 is constantly urged upward and can be pivoted. A hook 55 is mounted at a free end of the upper base assembly 51, and a bar 56 is mounted on the lower base assembly 52 at a position corresponding to both side of the hook 55, so the hook 55 can be engaged with the bar 56. In this manner, even if an external force acts on the upper base assembly 51, the upper base assembly 51 will not accidentally open. When the hook 55 is disengaged from the bar 56, the upper base assembly 51 is automatically pivoted and moved upward by the biasing force of the compression spring 541 in the support mechanism 54.

When the upper base assembly 51 is pivoted upward to be separated from the lower base assembly 52, the ribbon path of the thermal transfer ribbon 6 can be sufficiently exposed. In this condition, maintenance procedures such as replacement of the thermal transfer ribbon 6 and maintenance along the ribbon path can be easily performed. In addition, the upper base assembly 51 can be pivoted to sufficiently open a transfer paper path. Therefore, even if the paper Pa (Pb or Pc) is jammed, it can be easily removed.

Figure 5A:
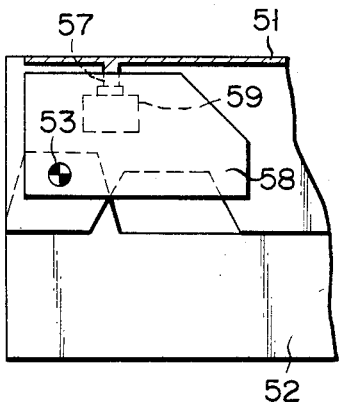
FIGS. 5(*a*) and 5(*b*) are respectively representations for explaining the opening/closing operation of an interrupt switch in a power source unit when the upper base assembly is opened/closed.
Figure 5B:
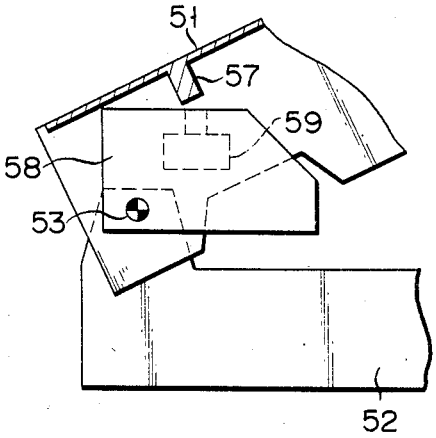

As shown in FIGS. 5(*a*) and 5(*b*), a switch button 57 arranged on the upper base assembly 51 opposes an interrupt switch 59 in a power supply unit 58 arranged in the lower base assembly 52. When the upper base assembly 51 is closed/opened, the switch 59 is turned on/off to energize/deenergize the printing apparatus.

The control section 50 is connected to the respective components arranged in the housing 1 and is connected to external equipment (not shown).

Figure 6:
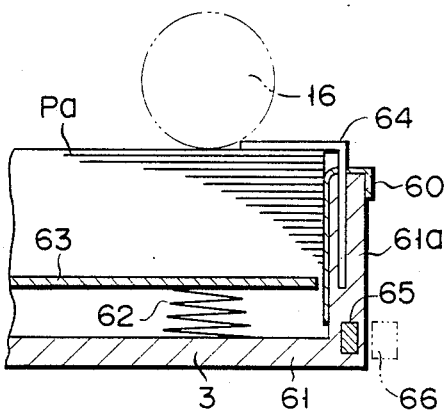
FIG. 6 is a sectional view showing the main part of a paper cassette.

When a printing instruction (printing data) is supplied from an external computer, a wordprocessor or the like, the printing apparatus is started. When the paper sheet cassette 3 is inserted into the printing apparatus, the paper sheet Pa is subjected to printing. The stepping motor 44 is driven in response to the printing instruction, described later, and the driving force is transmitted to the paper feed roller 16, which is then rotated counterclockwise. The sheet paper Pa is taken up from the paper cassette 3. In this case, a lubricant tape 60 (FIG. 6), as a lubricant member, is applied to the paper cassette 3 to smoothly take up the paper sheet Pa, so the roller 16 is properly brought into contact with the uppermost paper sheet Pa, thereby preventing erroneous paper feeding. As shown in FIG. 6, the sheets of paper Pa are supported on a paper support 63 which is biased upward by springs 62 in a cassette case 61 in the paper sheet cassette 3. Separation pawls 64 (only one pawl is illustrated in FIG. 6) are disposed at two upper front edges to hold the uppermost paper sheet Pa downward. For this reason, as shown in FIG. 1, when the paper sheet cassette 3 is loaded such that the front end thereof becomes lower than the rear end thereof, the leading ends of the sheets of paper Pa abut against the inner wall of a front frame 61*a* in the case 61, thereby increasing the frictional force between the paper and the cassette case. In this case, the paper sheet Pa will not be brought into contact with the roller 16 and will not be taken up. In order to prevent this, the lubricant tape 60, as a lubricant member, made of a low-friction plastic material is applied to the inner wall surface and the upper end face of the front frame 61*a* in the cassette case 61, thereby decreasing the frictional resistance so as to smoothly take up the paper sheet Pa by means of the roller 16.

A magnet 65 is embedded in the front frame 61*a* in the cassette case 61. The position of the magnet 65 is magnetically detected by a detector (e.g., two pairs of lead switches) 66 arranged in the cassette loading portion 22, so the presence of the paper cassette 3 is automatically detected.

Figure 7:
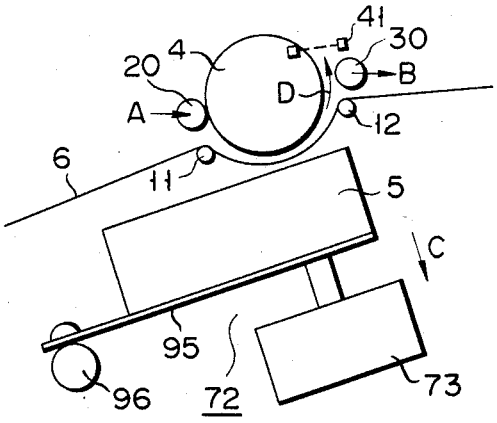
FIG. 7 is a representation of a mechanism including a platen roller shown in FIG. 1.

The paper sheet Pa taken up from the paper cassette 3 passes along the paper guide path 23 defined by the first and second guide plates 24 and 25, and a leading end of the paper Pa abuts against a rolling contact portion of the aligning rollers 15 which stop rotating. The leading end of the paper sheet Pa is aligned by the aligning rollers 15. Thereafter, the aligning rollers 15 are driven by the stepping motor 43, and the paper Pa is guided into a space between a paper feed guide 70 and a brake plate 71 in the braking means 21. As shown in FIG. 7, the paper feed pinch roller 20 is urged by the solenoid 47 toward the platen roller 4 (in a direction indicated by arrow A). The paper discharge pinch roller 30 is pulled by the solenoid 48 in the B direction and is separated from the platen roller 4.

Figure 8:
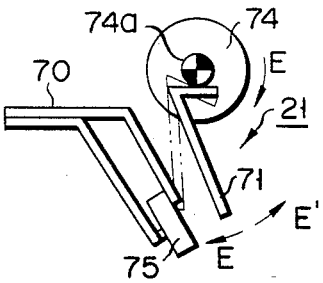
FIG. 8 is a representation of a braking means shown in FIG. 1.

On the other hand, since a plunger solenoid 73 as the drive source of a head moving mechanism 72 is deenergized, the thermal head 5 is moved in the C direction and is separated from the platen roller 4. The platen roller 4 is rotated by the stepping motor 43 counterclockwise, and the reel shaft 14 in the ribbon take-up reel 8 is rotated counterclockwise by the stepping motor 46. In addition, the solenoid 73 is energized, to simultaneously feed the paper sheet Pa and the thermal transfer ribbon 6 in the direction indicated by arrow D, by bringing the thermal head 5 into pressure contact with the platen roller 4. The detector 41 is arranged in the vicinity of the upper portion of the paper discharge pinch roller 30 to detect the leading end of the paper sheet Pa. The detector 41 comprises a light-emitting element and a light-receiving element. When the detector 41 detects the leading end of the paper sheet Pa (Pb), the stepping motor 46 is stopped to stop feeding the thermal transfer ribbon 6. The thermal head 5 is released from the platen roller 4 by the solenoid 73, the paper feed pinch roller 20 is released from the platen roller 4 by the solenoid 47, and the paper discharge pinch roller 30 is brought into contact with the platen roller 4 by means of the solenoid 48. As shown in FIG. 8, a rotary solenoid 74 in the braking means 21 is rotated clockwise to rotate a shaft 74*a* of the brake plate 71 in the E direction, thereby clamping the paper sheet Pa between the brake plate 71 and a friction member 75. In this state, the platen roller 4 is slightly rotated counterclockwise by the stepping motor 43 to wind the paper sheet Pa (Pb) around the platen roller 4, while the paper sheet Pa (Pb) is kept taut between the friction member 75 and the paper discharge pinch roller 30 by operating the brake force to paper sheet Pa (Pb). Thereafter, the solenoid 47 is operated to urge the paper feed pinch roller 20 against the platen roller 4. At the same time, the rotary solenoid 74 of the braking means 21 is rotated counterclockwise to rotate the brake plate 71 in the E′ direction, so the platen roller 4 is rotated clockwise to feed back the paper sheet Pa (Pb) into the vicinity of a contact portion between the platen roller 4 and the paper discharge pinch roller 30. In this state, the solenoid 73 is energized to urge the thermal head 5 against the platen roller 4. At the same time, the reel shaft 14 in the take-up reel 8 is rotated clockwise so as to feed the thermal transfer ribbon 6, and the platen roller 4 is rotated counterclockwise to start the transfer operation of the thermal head 5. In this ink transfer portion, the ink is heated and melted by the thermal head 5 and is transferred (printed on) to the paper sheet Pa (Pb). The ink-transferred paper sheet Pa (Pb) passes along the discharge paper guide path 31 formed between the guide plates 32 and 33. This paper sheet Pa (Pb) is then fed back into the direction of the discharge tray 2 at a position where the trailing end of the paper sheet Pa (Pb) is located in the vicinity of a contact portion between the platen roller 4 and the paper feed pinch roller 20. Thereafter, the rotary solenoid 74 of the braking means 21 is rotated clockwise to rotate the brake plate 71 in the E direction. At the same time, the solenoid 73 is turned off to separate the thermal head 5 from the platen roller 4. The platen roller 4 is rotated clockwise to feed back the paper sheet Pa along the return paper guide path 34 defined by the guide plates 35 and 36. In this case, the brake plate 71 returns along the E′ direction when the paper sheet Pa (Pb) is inserted between the guide plates 35 and 36. The feed back operation of the paper sheet Pa (Pb) is performed until the paper reaches the print start position. Thereafter, except for the case wherein the color is specified, the same operation is repeated for the specified number of color agents of the thermal transfer ribbon 6. When transfer (print) operation is completed, the paper sheet Pa (Pb) is discharged into the tray 2. Meanwhile, the leading end of the paper Pa (Pb) is discharged into the discharge tray 2, and the trailing end thereof is discharged into an intermediate portion between the discharge tray 2 and the manual feed tray 17.

Figure 9A:
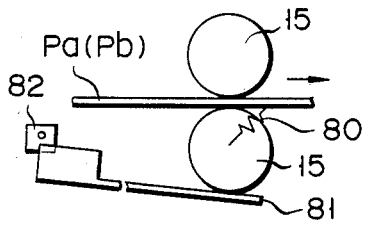
FIGS. 9(*a*) and 9(*b*) are respectively representations for explaining detection of double paper feeding of an aligning roller pair shown in FIG. 1.
Figure 9B:
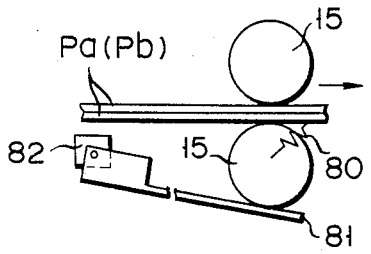

The aligning rollers 15 are arranged such that one aligning roller 15 is urged against the other aligning roller 15 by a spring 80, as shown in FIGS. 9(*a*) and 9(*b*). For this reason, the aligning rollers 15 are spaced apart from each other by a distance corresponding to a thickness of the paper sheet Pa (Pb). Even if two or more sheets of paper Pa (Pb) are fed, they are detected by a detector 82 through a lever 81 and are discharged into the discharge tray without being subjected to printing, thereby preventing color misregistration and jammed paper by double feeding. The lever 81 is arranged to magnify movement of one of the aligning rollers 15 by several tens of times. The detector 82 comprises light-emitting and light-receiving elements.

The thermal transfer ribbon 6 is fed by the stepping motor 46 from the ribbon supply reel 7 and is taken up by the ribbon take-up reel 8 through the ribbon guides 10, 11, 12 and 13. The ribbon detector 39 is arranged in the vicinity of the ribbon guide 10 to detect an identification code printed on the thermal transfer ribbon 6.

The detector 39 comprises the light-emitting element 37 and the light-receiving element 38. In this case, a plurality (e.g., four) of bar codes as identification signals are printed on the thermal transfer ribbon 6. By a combination of four bar codes, the type and color of the thermal transfer ribbon 6 can be identified. The colors of the thermal transfer ribbon 6 can be displayed on color display elements 85, 86, 87 and 88 in the operation section 42 to be described later. Therefore, without opening the upper base assembly, the operator can check the color of the thermal transfer ribbon 6. A rotary encoder 90 and a detector 91 are arranged in the vicinity of the ribbon guide 13 so as to set a boundary of color portions of the thermal transfer ribbon 6 in the vicinity of the printing point (FIGS. 1 and 2). When the rotary encoder 90 is started upon movement of the thermal transfer ribbon 6, the detector 91 counts the number of slits equidistantly formed in the rotary encoder 90, thereby detecting a feed distance of the thermal transfer ribbon 6. The leading end of the thermal transfer ribbon 6 whose color is detected by the detector 39 is located in the vicinity of a printing point 93, and the initial setting is automatically performed. The type of the thermal transfer ribbon 6 is automatically detected in a manner to be described later, and the mechanism control mode changes, thereby changing the printing range. In particular, when the thermal transfer ribbon 6 comprises a monochromatic ribbon, the printing range can beoome wider than that of the multi-color transfer ribbon.

When a multi-color transfer ribbon is used, and only one color of the plurality of ink colors is specified, only the specified color portion is used and other color portions are skipped. In particular, when a four-color transfer ribbon (black B, yellow Y, magenta M and cyan C) is used, the black portion (black B) is used in response to black printing data. In this case, when the next printing data represents black B again, the portions of yellow Y, magenta M and cyan C are skipped so as to immediately use the black portion.

Figure 10:
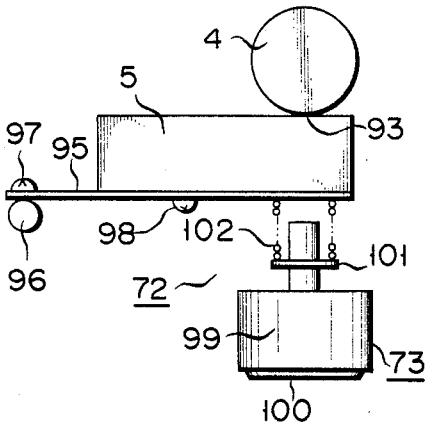
FIG. 10 is a representation of a thermal head moving mechanism shown in FIG. 1.
Figure 11:
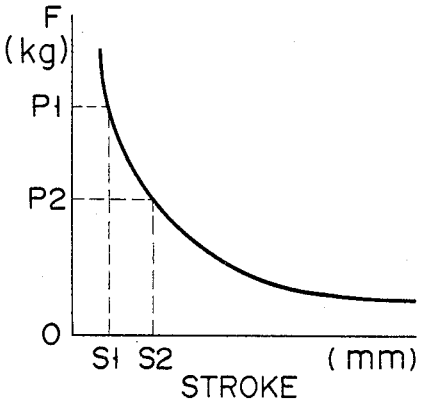
FIG. 11 is a graph showing the relationship between the stroke and the suction force of the latching solenoid and the compression load of a spring used in the thermal head moving mechanism shown in FIG. 10.
Figure 12:
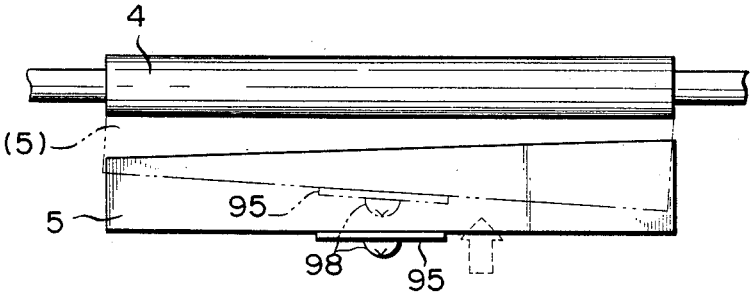
FIG. 12 is a representation for explaining the relationship between a thermal head and a platen.

The platen roller 4 must be repeatedly brought into contact with and then separated from the thermal head 5 to feed the paper Pa (Pb or Pc). As shown in FIG. 10, the thermal head driving mechanism comprises a leaf spring 95 for supporting the thermal head 5, a thermal head holding shaft 96 for supporting the leaf spring 95, set screws 97 and 98 (FIG. 12) for fastening the leaf spring 95 and the thermal head holding shaft 96, and the solenoid 73 for urging the thermal head 5 against the platen roller 4. When the solenoid 73 is energized, the thermal head 5 is urged against the platen roller 4. However, when the solenoid 73 is turned off, the thermal head 5 is released from the platen roller 4 by the weight of the thermal head 5. However, when the solenoid is directly coupled to the leaf spring 95, a positional error between the solenoid 73 and the thermal head 5 occurs to change the urging force, resulting in variations in urging forces of the printing apparatuses. According to the present invention, a gap (stroke) between an armature 99 and a flange 100 is decreased, and a spring 102 is inserted between the thermal head 5 and a stopper 101 arranged in the solenoid 73. As shown in FIG. 11, when a biasing force P2 is required, the spring 102 having a compression load F corresponding to the biasing force P2 is used. When the gap (stroke) is given to be S1, a margin (P1–P2) (kg) is obtained. In this manner, the holding force of the solenoid 73 can be larger than the biasing force P2, so a lower voltage can be applied to the solenoid 73, thereby decreasing power consumption. In addition, a compact solenoid can be used. As shown in FIG. 12, even if the printing surface (heating elements) of the thermal head 5 is inclined with respect to the platen roller 4, the leaf spring 95, as an elastic member, is urged upward by the solenoid 73, and the lead spring 95 is brought into uniform pressure contacting with the platen roller 4 with a uniform load distribution, as indicated by the broken line. As a result, nonuniform printing density can be eliminated, and defective printing can be prevented.

Figure 13:
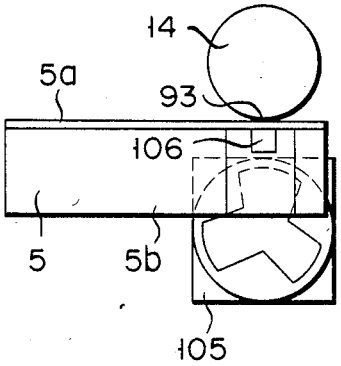
FIGS. 13 and 14 are respectively a side view and a front view of a cooling mechanism for the thermal head.
Figure 14:
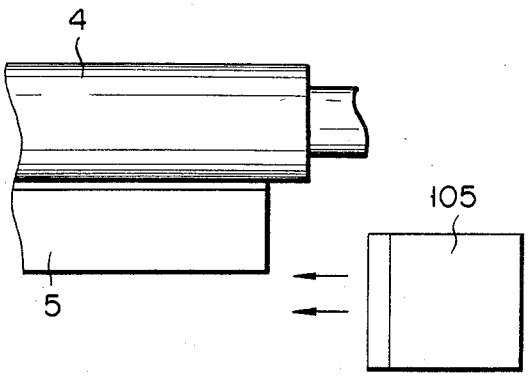

FIGS. 13 and 14 show the relationship between the thermal head 5 and a cooling fan 105. The thermal head 5 comprises a ceramic plate **5*a* having heating elements and a heat sink 5*b*. A pair of plate temperature detectors (semiconductor sensors) 106 detect changes in temperatures of the heating elements. The rotational speed of the cooling fan 105** is controlled in accordance with these changes, thereby improving cooling efficiency.

Figure 15:
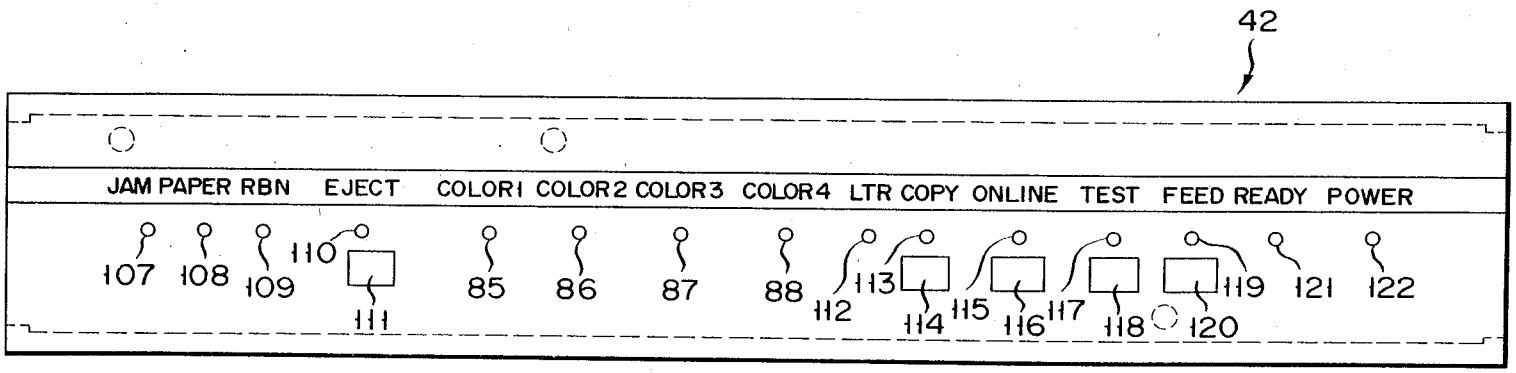
FIG. 15 is a plan view of a display/operation section shown in FIG. 1.

The display/input section 42 is illustrated in FIG. 15. A jammed paper (JAM) indicator 107, a paper empty (PAPER) indicator 108 and a ribbon empty (RBN) indicator 109 are arranged at the left portion of the section 42. Color (COLOR 1 to COLOR 4) indicators 85 to 88, an eject (EJECT) indicator 110, an eject (EJECT) key 111 and a letter (LTR) indicator 112 are arranged at the central portion of the section 42. A copy (COPY) indicator 113, a copy (COPY) key 114, an on-line (ON LINE) indicator 115, an on-line (ON LINE) key 116, a test (TEST) indicator 117, a test (TEST) key 118, a feed (FEED) indicator 119, a feed (FEED) key 120, a ready (READY) indicator 121 and a power (POWER) indicator 122 are arranged at the right side of the section 42.

The paper roll cassette 19 will be described with reference to FIGS. 16 to 18.

Figure 16:
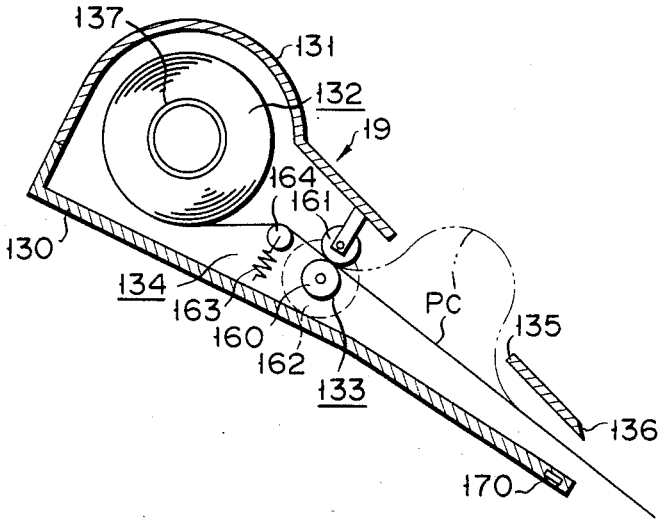
FIG. 16 is a longitudinal sectional side view of an adjustable paper roll feed cassette used in place of a sheet paper cassette shown in FIG. 1.

FIG. 16 shows the internal construction of the paper roll cassette 19. Reference numeral 130 denotes a cassette case. A cassette cover 131 covers the upper surface of the case 130. A paper roll loading portion 132, a paper roll feeding means 133 and a paper roll tension means 134 are arranged in the case 130. At the same time, an opening 135 is formed in the cassette cover 131. A cutter 136 is arranged at the distal end of the cover 131.

In the paper roll loading portion 132, two ends of a core 137 having the paper roll Pc thereon are supported by first and second reel units 138 and 139, respectively, as shown in FIG. 17.

The first reel unit 138 comprises a reel main body 141, one end of which is rotatably mounted on a shaft 140 fixed on a side frame **130*a* of the cassette case 130, a disk 143 constantly biased against the reel main body 141 by a conical coil spring 142 and fixed on the shaft 140, and a brake 144 arranged at opposing surfaces of the disk 143 and the reel case 141. The brake 144 comprises a stainless steel member 145 fixed on the disk 143 and a polyester-based unwoven fabric member 146 fixed on the reel main body 141**.

A pair of rotation preventing projections 147, engaged with a pair of notches **137*a* formed at end faces of the reel 9, are formed in the reel main body 141, thereby preventing the core 137 from slipping on the reel main body 141**.

The second reel unit 139 comprises a reel main body 149, one end of which is rotatably mounted on a fixed shaft 148, and a conical coil spring 150 for constantly biasing the first reel unit 138 against the reel main body 149. Referring to FIG. 17, the reel main body 149 holds the end portions of the core 137 and is moved downward against the biasing force of the conical coil spring 150.

An intermediate portion of the shaft 148 of the second reel unit 139 comprises a small-diameter portion through a tapered portion, so the reel main body 149 can be swung, and the core 137 can be easily detached.

Since the two ends of the core 137 are supported by the first and second reel units 138 and 139, the core 137 will not be rotated due to the frictional force by the brake 144 and the steel member 145 unless a predetermined force acts thereon, so that accidental feeding of the paper roll Pc wound around the core 137 can be prevented. In addition, a predetermined tension acts on the paper roll Pc which is thus kept taut.

The paper roll cassette 19 is set in place of the sheet paper cassette 3 to perform printing. The core 137 having the paper roll Pc wound thereon is held by the first and second reel units 138 and 139 incorporated in the cassette case 130.

The cassette cover 131 is mounted on the cassette case 130. The cassette case 130 is then clamped between rollers 160 and 161 constituting the paper roll feeding means 133. At the same time, the paper roll Pc is fed through a knob 162 to an exit position. The leading end of the paper roll Pc is cut by the cutter 136 arranged at the distal end of the cassette cover 131 to align the leading end. In this case, the paper roll tension means 134 having a buffer effect is arranged between the paper roll loading portion 132 and the paper roll feeding means 133 and comprises a tension arm 164, which is constantly biased by a spring 163 in a predetermined direction.

In this manner, as shown in FIG. 18, the paper roll cassette 19 is loaded in the cassette loading portion 22. In this case, the position of a magnet 170 embedded in the cassette case 130 is detected by the detectors (lead switches) 66 arranged in the cassette loading portion 22, thereby automatically detecting that the roll paper cassette 19 is set. More particularly, the position of the magnet 65 for the paper sheet, as shown in FIG. 6, is different from that of the magnet 170 for the paper roll, as shown in FIG. 18, and these positions are respectively detected by the detectors 66, thereby allowing discrimination between the paper roll cassette 19 and the paper sheet cassette 3.

The knob 162 is rotated to dispense the leading end of the paper roll Pc. The leading end of the paper passes between the guide plates 24 and 25 in the same manner as in the paper sheet cassette 3. When the feed key 120 in the display/input section 42 is pressed, the aligning rollers 15 and the like are driven to feed the paper roll Pc along the same feed path as in the paper sheet Pa (or Pb), and the paper roll is discharged into the discharge tray 2. In this state, when the eject key 111 in the display/input section 42 is pressed, the automatic paper feed is separated, and the paper roll Pc is fed by a desired length to correct the skew of the paper roll Pc. The paper roll Pc is then kept taut and is subjected to printing in the same manner as the paper sheet Pa (or Pb). When a plurality of color inks are used to perform multi-color printing, the paper feed pinch roller 20 and the paper discharge pinch roller 30 are brought into tight contact with the platen roller 4, the solenoid 73 is turned off to separate the thermal head 5 from the platen roller 4, and the platen roller 4 is rotated clockwise by the stepping motor 43, thereby feeding back the paper roll Pc. In this case the paper roll Pc is loosened at the opening 135 formed in the cassette cover 131. When the paper roll Pc is skewed, the eject key 111 in the display/input section 42 shown in FIG. 15 is pressed to separate automatic paper feeding, and the skew of the paper roll Pc is corrected.

The printed paper roll Pc is then discharged into the discharge tray 2 and is cut by a cutter 171 arranged at the discharge port. A detailed operation of paper roll printing will be made later on.

Figure 19:
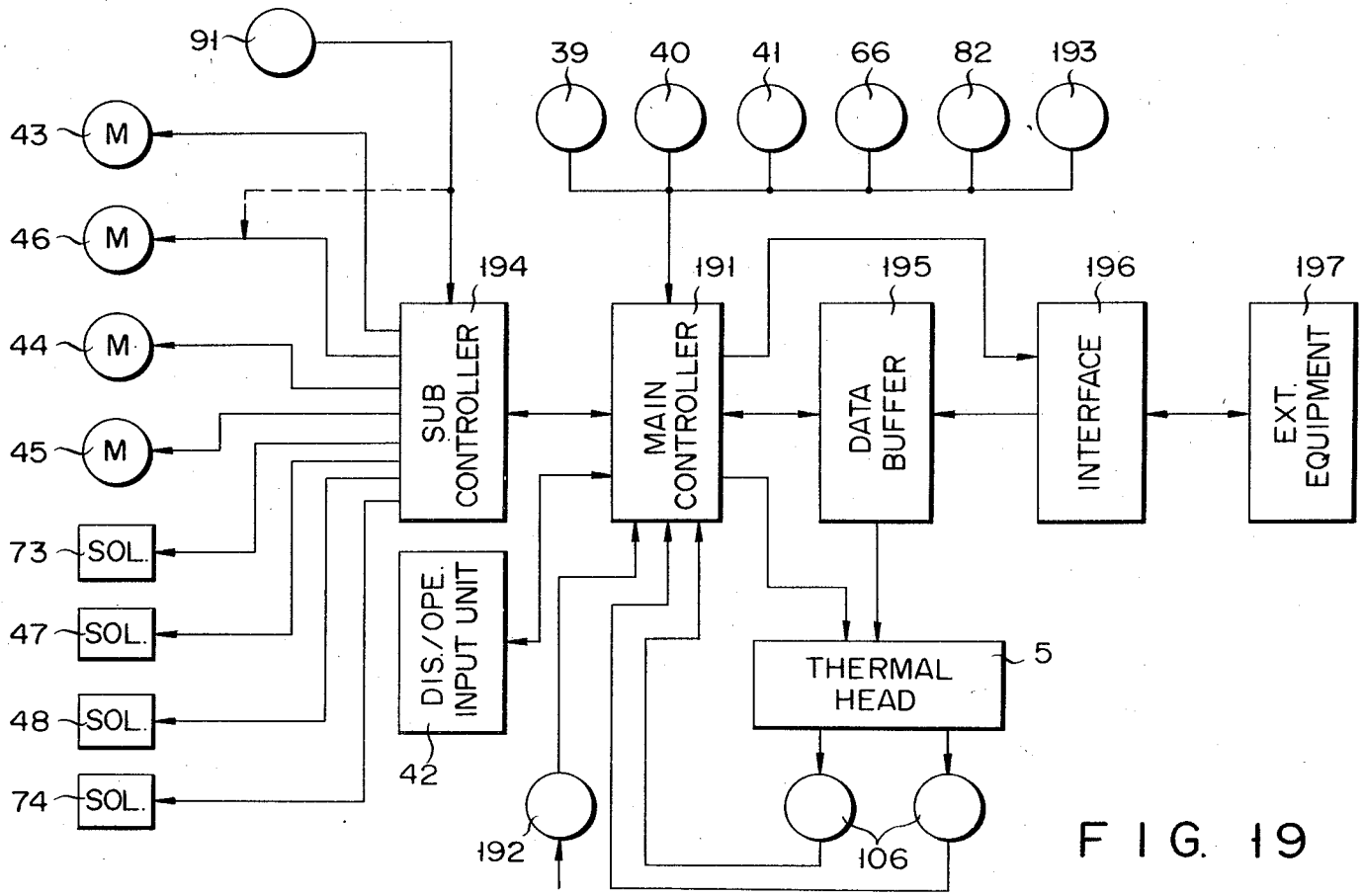
FIG. 19 is a block diagram schematically showing a control circuit included in a control section shown in FIG. 1.

The control circuit included in the control section 50 will be described with reference to FIG. 19. As shown in FIG. 19, a main controller 191 receives control signals from the display/input section 42, output signals from the respective sensors (i.e., the ribbon detector 39, the paper detector 40, the paper trailing end detector 41, the cassette detector 66, the aligning roller opening/closing detector 82, the plate temperature detectors 106 for the thermal head 5, a printing medium temperature detector 192 and a discharge paper detector 193), an output signal from a discharge roller opening/closing detector (not shown), and an output signal from a sub controller 194. In response to these signals, the main controller 191 supplies predetermined control signals to the display/input section 42, the sub controller 194, the thermal head 5, a data buffer (memory) 195, and an interface 196. The display/input section 42 supplies a predetermined operation signal to the main controller 191 and receives a control signal from the main controller 191 to perform display corresponding to the predetermined operation. The sub controller 194 controls the pulse motor 43, the ribbon take-up stepping motor 46, the feed stepping motor 44, the manual feed stepping motor 45, the thermal head 5 drive solenoid 73, the pinch roller 20 drive solenoid 47, the pinch roller 30 drive solenoid 48, and the brake plate 41 drive rotary solenoid 74 in response to the control signals from the main controller 191 and the detector 91 of the rotary encoder 90. The data buffer 195 stores one-line every time printing data supplied from external equipment 197 through the interface 196 in response to the control signal from the main controller 191. The stored printing data is supplied to the thermal head 5. The thermal head 5 heats and melts an ink on the thermal transfer ribbon 6 in accordance with the control signal from the main controller 191 and the printing data from the data buffer 195. The melted ink is transferred to the paper sheet Pa, Pb or Pc.

The interface 196 causes the main controller 191 to exchange signals with the external equipment 197. The interface 196 supplies a vertical sync signal (page sync signal), a horizontal sync signal, a clock signal and a status signal representing the operating state of the printing apparatus to the external equipment 197. The interface 196 receives command signals (e.g., a start signal, a stop signal and a color designation signal) and printing data from the external equipment 197. When the printing data is patterned, it is directly stored in the data buffer 195. When a character code is entered, it is converted into a character pattern by a code interface control circuit (not shown) and a character generator (not shown), and the character pattern is then stored in the data buffer 195.

The cassette detector 66 will be described in more detail. The detector 66 comprises two pairs of lead switches. These lead switches are operated by the magnets arranged at different positions in the roll sheet cassette 19 and the paper sheet cassette 3. The main controller 191 detects which one of the lead switches is operated and which cassette is loaded. The printing operation mode is automatically set in the roll or paper sheet printing mode in accordance with the type of cassette loaded in the insertion port. The respective components of the printing apparatus will be described in accordance with the selected printing mode.

Unlike a conventional printing apparatus, wherein either the roll or the paper sheet cassettes is loaded, the printing apparatus of the present invention has an advantage in its application, in that the paper roll cassette 19 and the paper sheet cassette 3 can be loaded in the same loading portion 22. In addition, the control section automatically detects which one of the cassettes is loaded and also automatically sets the printing mode in accordance with the loaded cassette, thereby improving operability.

Furthermore, the cassette detection signal is supplied to the external equipment 197 through the interface 196 in response to a status signal, so that the external equipment 197 can also detect which cassette is loaded, resulting in convenience.

The thermal head 5 will be described in more detail. The thermal head 5 can be driven in zero to four steps in accordance with the count representing the number of one-line data. It should be noted that zero indicates that no printing data is present. The thermal head 5 has the heating elements aligned in a row. These elements correspond to 1,728 dots. The 1,728 dots are divided into four blocks: three blocks having 448 dots each and another block having 384 dots. When a three-or four-color ribbon is used, one-line processing (data transfer to the thermal head 5 and driving of the thermal head 5) time is predetermined in accordance with the four-way drive system in order to prevent paper misalignment and color misregistration. Unlike the conventional incremental paper feed/discharge method wherein an order of printing, paper feed, printing, . . . is adopted, paper feeding and printing are simultaneously performed in the apparatus of the present invention. More particularly, in the incremental method, the paper must be stopped at the time of printing. However, in practice, the paper cannot be completely stopped even in the incremental method. Therefore, even if printing and paper feeding are simultaneously performed, this method can be regarded as the same as the incremental method. One- or two-color printing, which does not require color ink overlapping, can be performed by the above method of the present invention. In this case, the thermal head is divided into a range of 0 to 4 blocks and is driven, the processing time intervals for the divided blocks for one line differing from each other. In other words, color misregistration will not substantially occur, and the printing speed can be increased.

Figure 20:
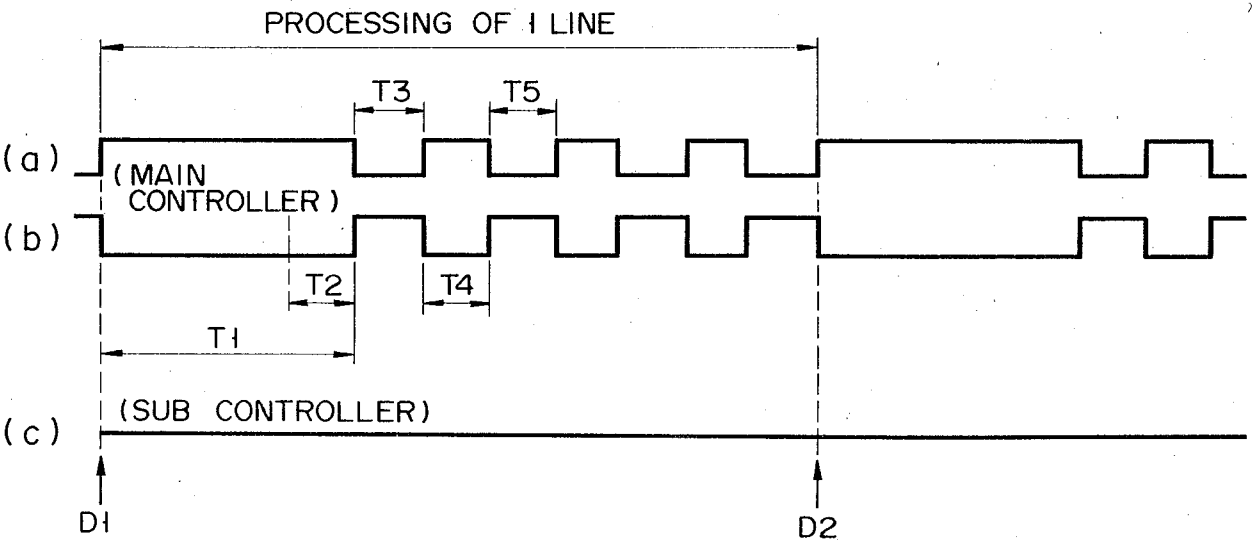
FIG. 20 is a timing chart for explaining the operation of main and sub controllers included in the control circuit shown in FIG. 19.

Printing data transfer is performed in a manner shown in FIG. 20. During a time interval T1, 1,728-bit data is stored from the external equipment 197 in the data buffer 195. During a time interval T2 in the time interval T1, 448-bit data of the first block stored in the data buffer 195 is transferred to the thermal head 5. When all data are stored in the data buffer 195, the data of the first block is printed during a time interval T3. Thereafter, 448-bit data of the second block is transferred to the thermal head 5 during a time interval T4 and is printed during a time interval T5. Subsequently, the 448-bit data of the third block and 384-bit data of the fourth block are transferred to the thermal head 5 and are printed. The subcontroller 194 drives the stepping motor 43 and the ribbon take-up stepping motor 46 at times D1 and D2.

In printing control by the thermal head 5, it is very important to detect an increase in an ambient temperature (external temperature), a temperature caused by heat generated by the electric circuit, and a plate temperature of the thermal head 5. The increases in ambient temperature and temperature caused by heat from the circuit are greatly associated with the thermal transfer ribbon 6 and paper, especially a melting state of the thermal transfer ribbon 6. The printing medium temperature detector 192 is arranged to detect the temperatures of the corresponding components. The latter temperature rise is caused by heat storage of the thermal head 5 when continuous printing is performed. The pair of plate temperature detectors 106 are arranged to detect an increase in the temperature of the thermal head 5. These detectors 106 correspond to end blocks of the four blocks constituting the thermal head 5, respectively.

According to the arrangement described above, even if printing patterns of sentences concentrated at the left-hand side of the paper are to be printed, a difference between the stored head at the right side of the thermal head 5 and that at the left side thereof can be detected. Therefore, the ON time of the heating resistors of the right and left end blocks can be controlled to perform stable temperature control. In addition, the temperature information of the thermal transfer ribbon 6, which is detected by the printing medium temperature detector 192, can be used as a parameter to perform better printing.

The detectors 106 are arranged at positions corresponding to the right and left end blocks of the thermal head 5, respectively. However, the detector layout is not limited to the case described above. The detectors may be arranged at positions corresponding to the four blocks of the thermal head 5, respectively, thereby performing better printing.

Automatic detection of the thermal transfer ribbon using the ribbon detector 39 will be described. As previously described, the identification code such as a 4-bit bar code 201 corresponding to the type and color of the ribbon is printed at one side of the thermal transfer ribbon 6, as shown in FIG. 21. The bar code 201 comprises light-transmitting portions 202 and light-shielding portions 203, which start from a position spaced by a distance l2 from the boundary of each color portion of the thermal transfer ribbon 6, which are formed at a pitch l3 and each of which has a width of l1. The bar code 201 is detected by the ribbon detector 39, so the type and color of ribbon can be discriminated. Bar codes of the respective ink ribbons are summarized in the following table. Even if the ink ribbons have the same color, the bar codes differ in accordance with the types of thermal transfer ribbons 6.

| | | Bar code | | | |
|---|---|---|---|---|---|
| Ribbon | Color | 1 | 2 | 3 | 4 |
| One-color | Black | 0 | 0 | 0 | 0 |
| Two-color | Black | 1 | 0 | 1 | 1 |
| | Red | 1 | 0 | 0 | 1 |
| Three-color | Yellow | 1 | 0 | 1 | 0 |
| | Magenta | 1 | 1 | 0 | 0 |
| | Cyan | 1 | 0 | 0 | 0 |
| Four-color | Bk(black) | 1 | 1 | 0 | 1 |
| | Yellow | 1 | 1 | 1 | 0 |
| | Magenta | 1 | 1 | 0 | 0 |

-continued

| Ribbon | Color | Bar code 1 | 2 | 3 | 4 |
|---|---|---|---|---|---|
| | Cyan | 1 | 0 | 0 | 0 |
| END | | 1 | 1 | 1 | 1 |

The main controller 191 discriminates the type and color of the thermal transfer ribbon 6 in accordance with the bar code detected as a ribbon identification signal. Printing is performed in accordance with the ribbon identification signal.

Figure 23:
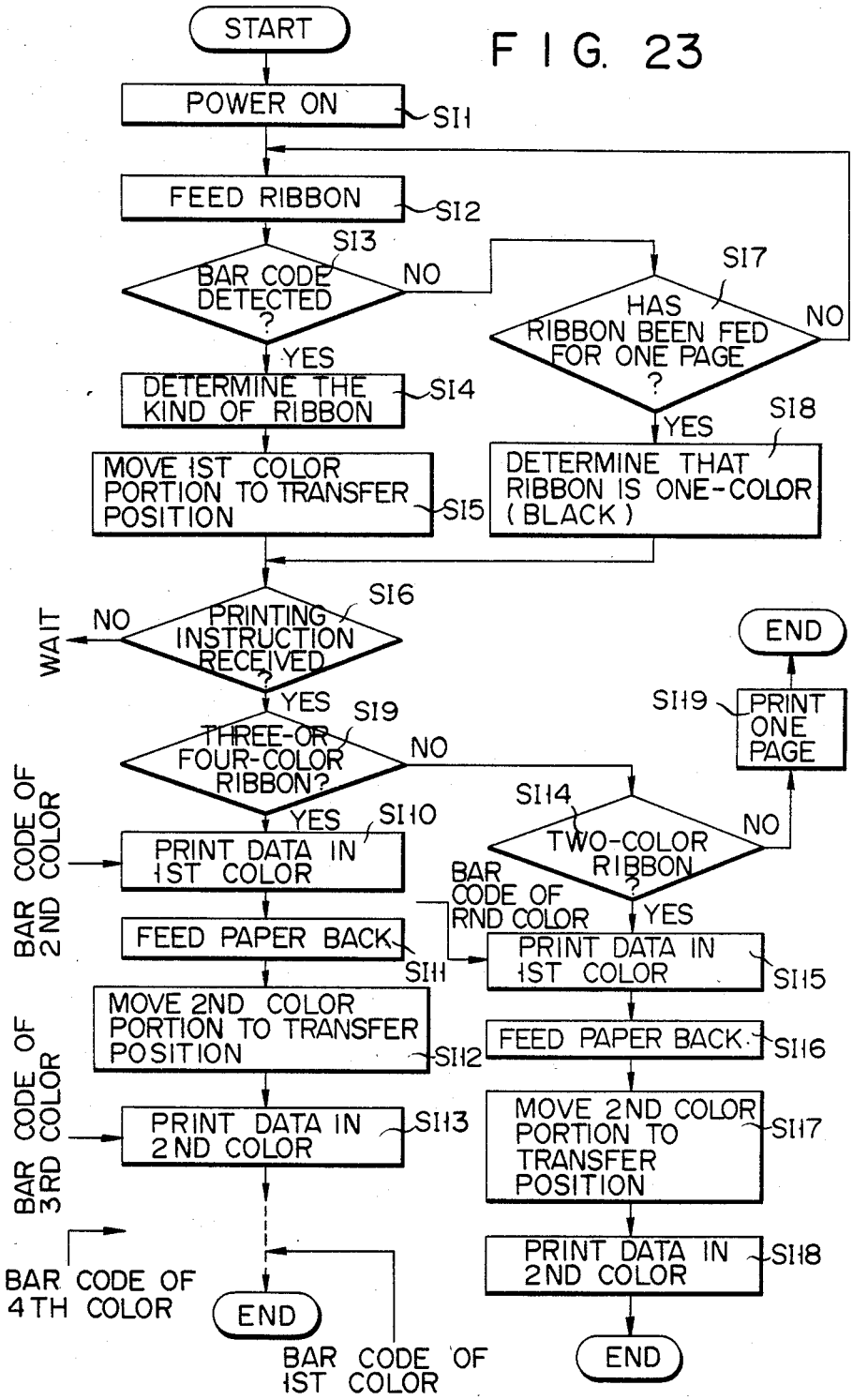
FIG. 23 is a flow chart for explaining the operation in accordance with the kind of transfer ribbon.

In step SI1 in FIG. 23, when the power source section 50 is turned on, the thermal transfer ribbon 6 is fed in step SI2. When the bar code 201 is detected by the ribbon detector 39 in step SI3, the type (including color information) of thermal transfer ribbon 6 is discriminated in step SI4. This discrimination is performed in accordance with the above table. When the type of thermal transfer ribbon 6 is discriminated, the thermal transfer ribbon 6 is fed by a first color portion in step SI5. Thereafter, the main controller 191 detects the presence/absence of a printing instruction in step SI6. When the printing instruction is not present, the printing apparatus is set in the standby mode. However, when the bar code 201 is not detected in step SI3, the main controller 191 detects in step SI7 whether or not the thermal transfer ribbon 6 is fed by a one-page portion (i.e., the one-color portion). If NO in step SI7, the flow returns to step SI2. However, if YES in step SI7, the ribbon 6 is detected to be a one-color (black only) ribbon in step SI8. The flow then advances to step SI6.

When the main controller 191 detects in step SI6 that the printing instruction is present, it determines in step SI9 whether the thermal transfer ribbon 6 is a 3- or 4-color ribbon. If YES in step SI9, the printing control operation for a 3- or 4-color ribbon is performed. More particularly, the first color portion is printed in step SI10, and the paper is fed back to the printing position in step SIll. Thereafter, the ribbon 6 is fed to the second color portion in step SI12, and second color printing is performed. In the same manner as described above, the third color portion or the third and fourth color portions are printed.

However, when the main controller 191 detects in step SI9 that the thermal transfer ribbon 6 is not a three- or four-color ribbon, it detects in step SI14 whether or not the ribbon is a two-color ribbon. If YES in step SI14, the first color printing is performed in step SI15, the paper is fed back in step SI16 and, at the same time, the ribbon 6 is fed by the second color portion in step SI17. Second color printing is then performed in step SI18.

On the other hand, when the main controller 191 detects that the ribbon 6 is not a two-color ribbon (i.e., the ribbon 6 is a one-color ribbon), one-page printing with the black ink is performed in step SI19.

The next color detection is performed by the ribbon detector 39 while the printing operations are performed in steps SI10, SI13 and SI15. When the type of thermal transfer ribbon 6 is discriminated, the corresponding indicator at the display/input section 42 is turned on.

In the state wherein a two-, three- or four-color ribbon is loaded, when color is determined by the external equipment 197, printing with the specified color is performed. The ribbon is then fed at a speed higher than the ribbon feed speed for printing such that the next portion of the specified color is located at the printing position. In this manner, any other color portion is skipped. This feeding operation is synchronized with the output signal from the ribbon detector 39.

A number of thermal transfer ribbons 6 can be selectively used. When a desired ribbon 6 is set as needed, the kind of ribbon 6 can be automatically discriminated. In addition, the printing operation is performed in accordance with the selected ribbon 6, thereby greatly improving operability.

Furthermore, the automatically discriminated thermal transfer ribbon 6 can be indicated at the display/input section 42, so that erroneous printing caused by an undesired ribbon can be prevented.

Furthermore, when the automatically detected ribbon 6 is a one-color ribbon, the paper need not be printed in the condition supported with the pinch rollers 20 and 30 on the paper. As a result, the paper can be printed from one end to other end of the paper, the printing range of the one-color ribbon can be wider than that of doble printing using a multi-color ribbon.

A plurality of thermal transfer ribbons can be automatically discriminated and selectively used. Inconvenience caused by performing two-color printing with a four-color thermal transfer ribbon can be prevented.

Furthermore, since the feed distance of the thermal transfer ribbon is detected by the rotary encoder 90 and the detector 91, color portion alignment can be properly performed with a relatively simple arrangement, so that printing errors can be completely prevented.

The ink ribbon is detected by using the bar code, so a simple detection arrangement can be used.

The color portions excluding the specified color portions are fed at a higher speed than the normal feeding speed for printing and are skipped. In this manner, even if a multi-color ribbon is used to perform printing with a smaller number of colors, the total printing time can be shortened.

The end detection of the paper roll will be described. Rectangular through holes 204 are formed at two side positions about 500 mm before the end of the paper roll Pc, as shown in FIG. 24. When the paper leading end detector 41 detects these through holes 204, the main controller 191 causes the indicator 108 in the display/input section 42 to be turned on, thereby performing paper empty display. The area defined by the trailing end and the through holes 204 corresponds to a size exceeding a single A4 size, so that this area can be used to perform A4 or letter size printing.

The terminal end of the paper roll can be properly detected, so that incomplete printing can be prevented. In addition to this advantage, the remaining area can be subjected to one-sheet printing.

Figure 25:
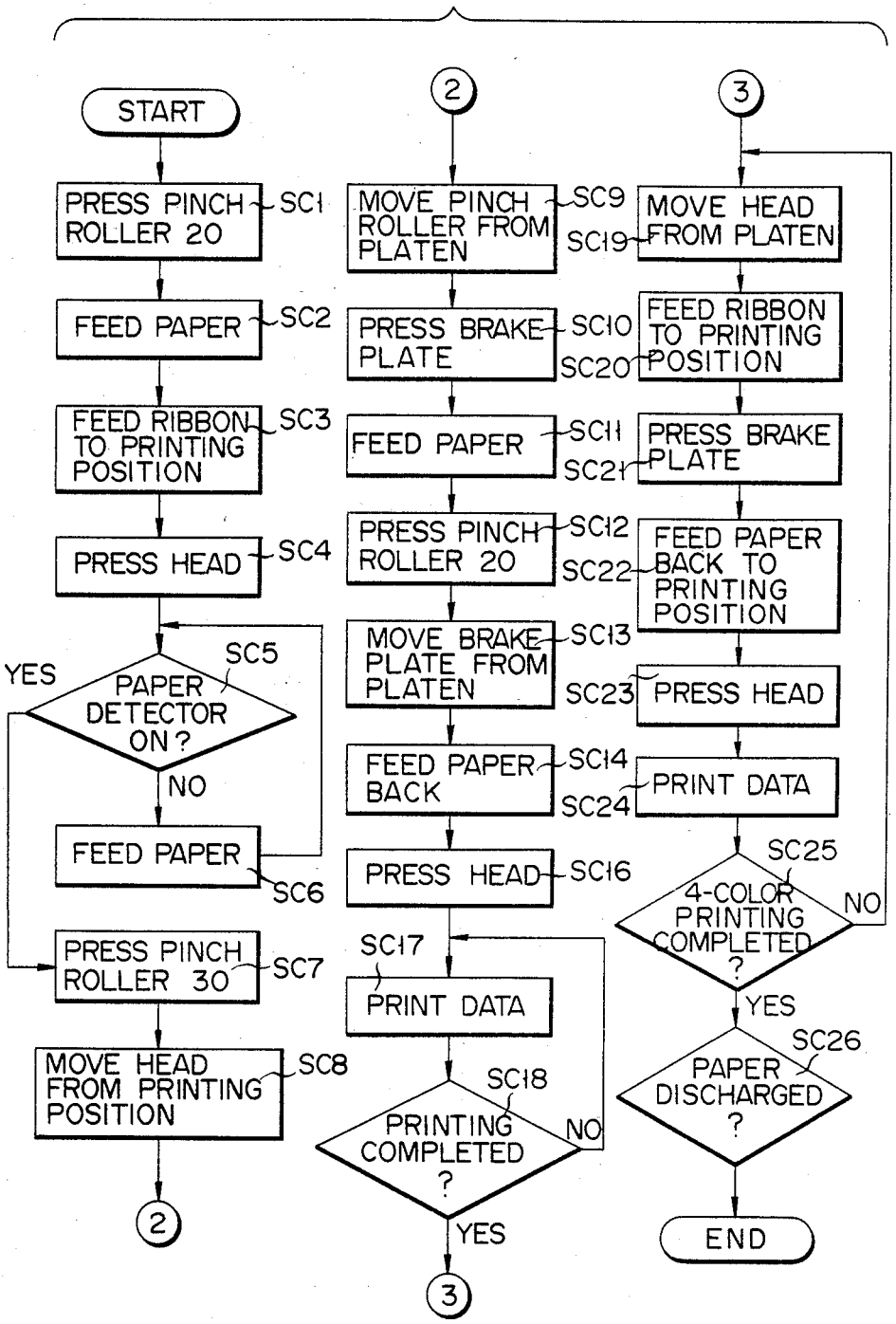
FIG. 25 is a flow chart for explaining the printing operation when sheet paper is used.

The printing operation on a paper sheet or roll will be described. The paper sheet or roll is detected in the manner described above. The printing operation of a paper sheet will be described with reference to FIGS. 25 and 26.

When a start signal is supplied from the external equipment 197 to the main controller 191, the pinch roller 20 is urged against the platen roller 4 in step SC1. The paper feed roller 16, the aligning rollers 15 and the platen roller 4 are driven in step SC2, so the paper sheet Pa is fed as shown in FIGS. 26(*a*) and 26(*b*). At the same time, in step SC3, the ribbon take-up reel 8 is driven, and a predetermined ink portion of the thermal transfer ribbon 5 is fed to the printing point. Upon ribbon feeding, the thermal head 5 is urged against the platen roller 4 in step SC4. In this state, the main controller 191 detects in step SC5 whether or not the leading end of the paper sheet Pa is detected by the paper leading end detector 41. If NO in step SC5, steps SC6 and SC5 are repeated to feed the paper sheet Pa. As shown in FIG. 26(*c*), when the leading end of the paper sheet Pa is detected by the detector 41, the pinch roller 30 is urged against the platen roller 4 in step SC7, and the thermal head 5 is separated from the platen roller 4 in step SC8. In step SC9, the pinch roller 20 is separated from the platen. In step SC10, the brake plate 71 is urged. In step SC11, the paper sheet Pa is slightly fed upon rotation of the platen roller 4. As shown in FIG. 26(*d*), the paper sheet Pa is kept taut. In step SC12, the pinch roller 20 is urged against the platen roller 4. In step SC13, the brake plate 71 is kept separated from the platen. In this condition, as shown in FIG. 26(*e*), the platen roller 4 is rotated in the reverse direction in step SC14. As a result, the paper sheet Pa is fed back to printing start position. In this case, the paper sheet Pa is clamped between the pinch rollers 20 and 30 and the platen roller 4 while it is kept taut. In this manner, after the printing start position of the paper sheet Pa is set, in step SC16, the thermal head 5 is urged against the platen roller 4. In step SC17, as shown in FIG. 26(*f*), printing is started. Until the print end signal (i.e., a page sync signal or a stop signal) is detected in step SC18, steps SC17 and SC18 are repeated. When a printing end is detected, in step 19 thermal head 5 is released from the platen roller 4, the thermal transfer ribbon 6 is fed such that the next color portion is located at the printing position in step SC20. Furthermore, in step SC21, the brake plate 71 is urged against the platen. In step SC22, as shown in FIG. 26(*g*), the paper sheet Pa is fed back to the printing point. In this case, the paper sheet Pa is held between the paper guide paths 35 and 36, as shown in FIG. 26(*h*). Thereafter, in step SC23, the thermal head 5 is urged against the platen roller 4, and the next color printing is started in step SC24. The main controller 191 detects in step SC25 whether or not printing with all colors is completed in accordance with the color designation signals. If NO in step SC25, steps SC19 to SC25 are repeated. When printing with all specified colors is completed, the discharge rollers 29 are driven in step SC26, and the printed paper sheet is discharged into the discharge tray (not shown).

The above description refers to multi-color printing. However, one-color printing can be achieved in the same manner, except that the paper sheet is discharged when the first color printing is completed. One- or multi-color printing is controlled in accordance with the detected thermal transfer ribbon type and color designation signals.

The printing operation of a paper roll will be described with reference to FIGS. 27 and 28.

Figure 27A:
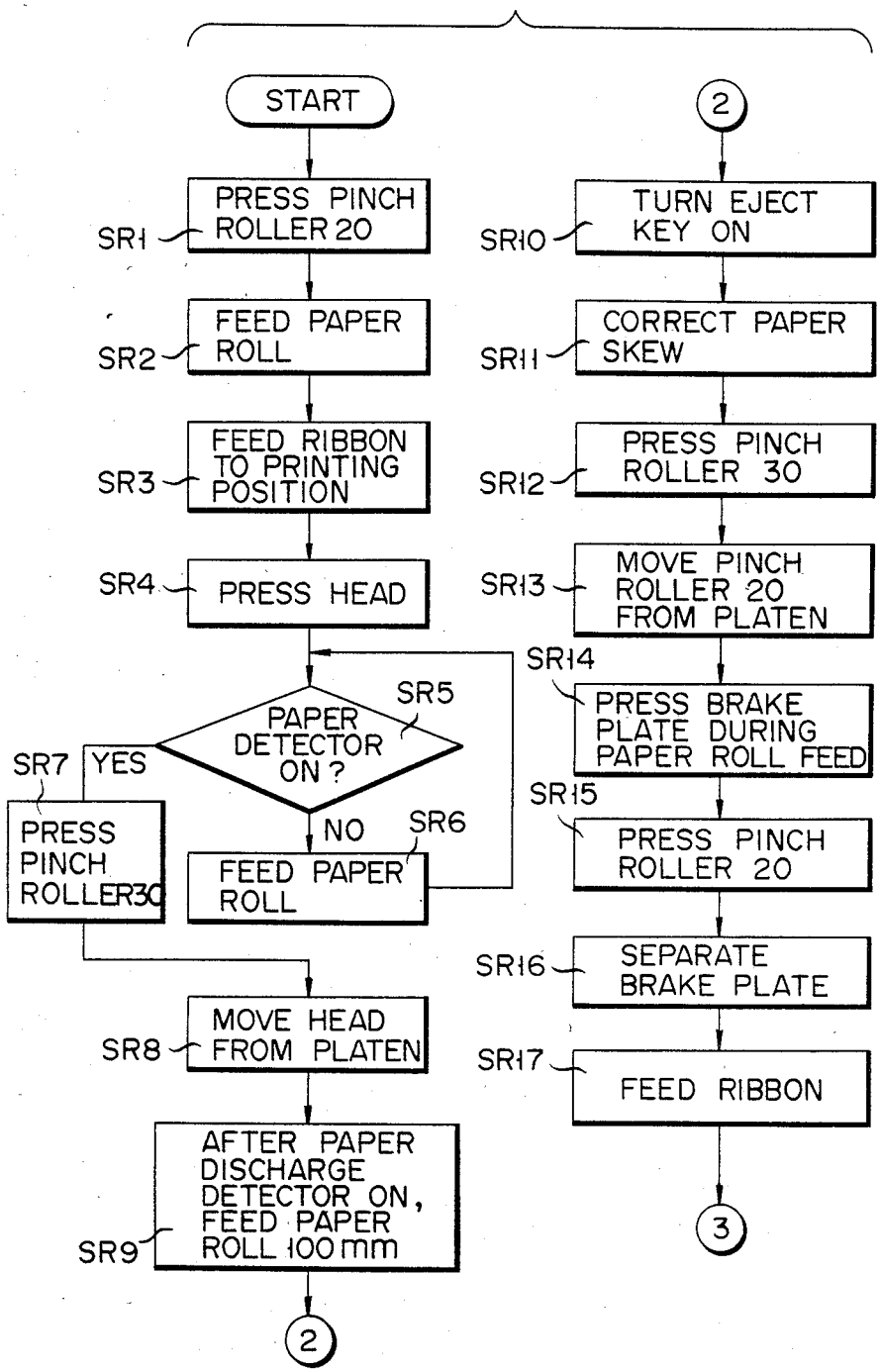
FIGS. 27(*a*) and 27(*b*) are flow charts for explaining the printing operation when the paper roll is used.
Figure 27B:
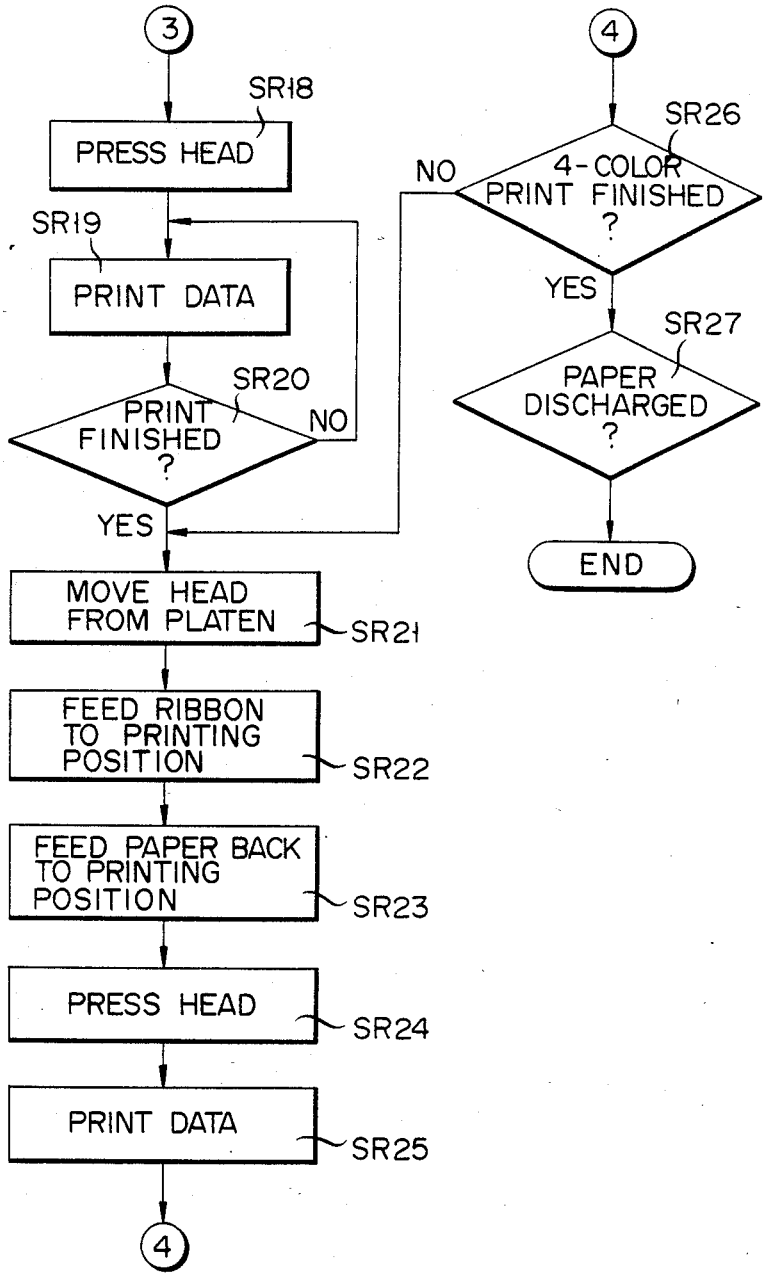
Figure 28A:
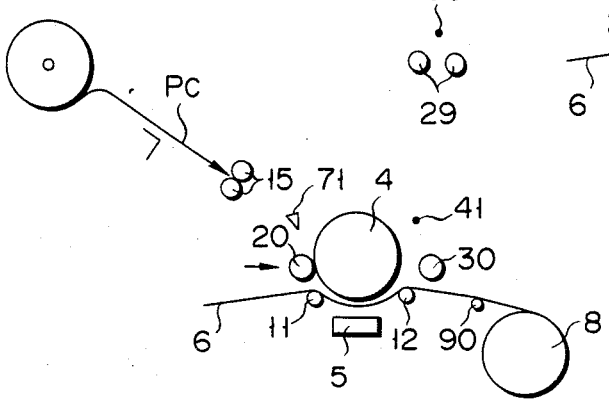
FIGS. 28(*a*) to 28(*h*) are respectively representations for explaining the respective components corresponding to the flow chart of FIG. 27.
Figure 28B:
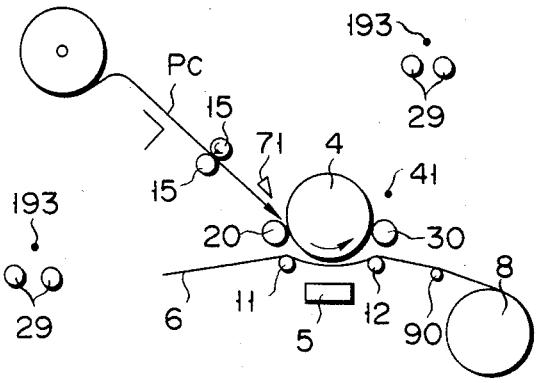
Figure 28C:
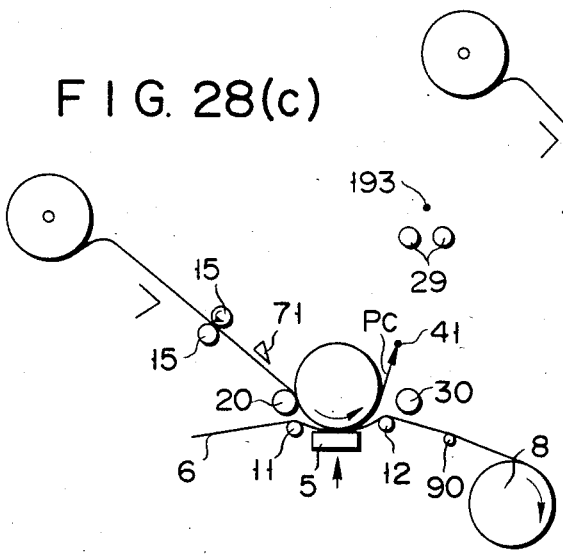
Figure 28D:
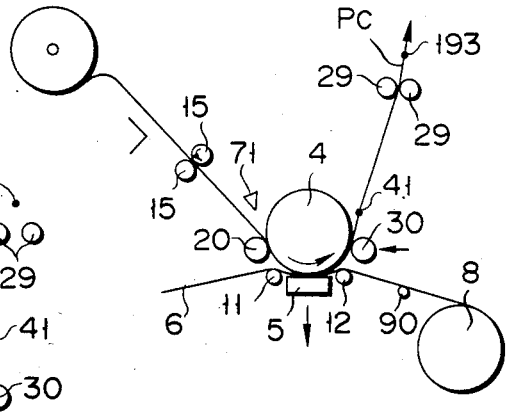
Figure 28F:
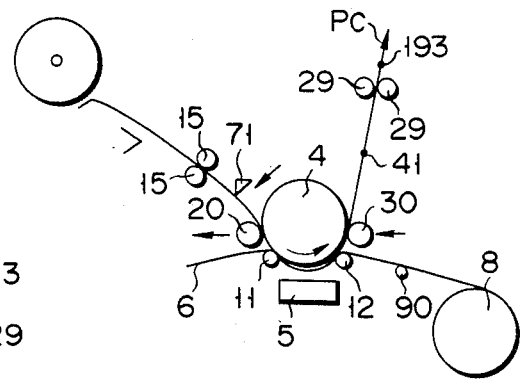
Figure 28E:
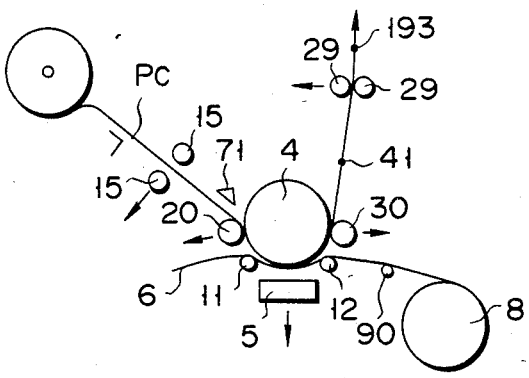
Figure 28H:
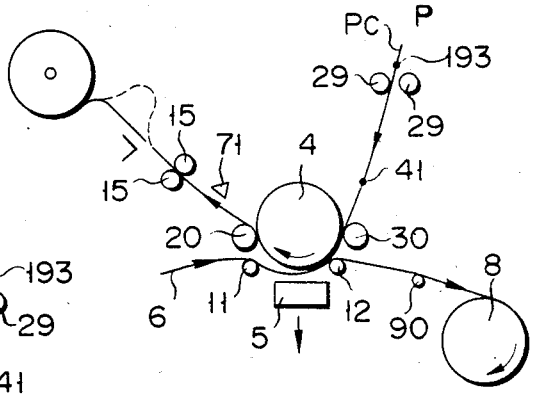
Figure 28G:
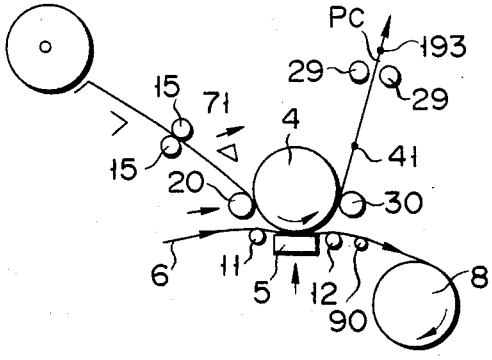

In step SR1 in FIGS. 27(*a*) and 27(*b*), when the operator presses the feed key 120 in the display/input section 42, the pinch roller 20 is urged against the platen roller 4. Thereafter, in step SR2, the aligning rollers 15 and the platen roller 4 are driven. In this state, when the cassette knob (not shown) is turned to feed out the leading end of the roll sheet Pc, the roll sheet Pc is fed, as shown in FIGS. 28(*a*) and 28(*b*). At the same time, in step SR3, the ribbon take-up reel 8 is driven and the predetermined ink portion is fed to the printing position. Upon ribbon feeding, the thermal head 5 is urged against the platen roller 4 in step SR4. In this state, the main controller 191 detects in step SR5 whether or not the leading end of the paper roll Pc is detected by the paper leading end detector 41. If NO in step SR5, steps SR6 and SR5 are repeated to feed the paper roll Pc. However, when the leading end of the paper roll Pc is detected by the detector 41, as shown in FIG. 28(*c*), the pinch roller 30 is urged against the platen roller 4, the thermal head 5 is separated from the platen, and the paper roll Pc is fed in steps SR7 and SR8. As shown in FIG. 28(*d*), when the paper roll Pc is detected by the paper discharge detector 193, the paper roll Pc is further fed by 100 mm in step SR9. Thereafter, in step SR10, the eject key 111 in the display/input section 42 is manually turned on to release the rollers 15, 20, 30, 29 and the thermal head 5, as shown in FIG. 28(*e*). In this state, skew adjustment of the paper is performed in step SR11. When such skew adjustment is performed (i.e., when the eject key 111 is manually turned off) in steps SR12, SR13 and SR14, as shown in FIG. 28(*f*), the pinch roller 30 is pressed, the pinch roller 20 is separated from the platen, and the brake plate 71 is pressed while the paper is being fed, so that the roll sheet Pc is held taut. Thereafter, in steps SR15, SR16, SR17, SR18 and SR19, the pinch roller 20 is pressed, the brake plate 71 is separated from the friction member 75, the thermal transfer ribbon 6 is fed, and the thermal head 4 is urged against the platen through the paper to start printing, as shown in FIG. 28(*g*). The end of printing is detected in step SR20. However, when the end of printing is not detected, steps SR19 and SR20 are repeated. When the end of printing is detected in step SR20, the thermal transfer ribbon 6 is fed such that the next color portion is located in the printing point, the thermal head 5 is separated from the platen, and the paper roll Pc is fed back in the roll paper cassette (not shown), such that a portion subjected to printing is located in a position immediately before the printing position in steps SR21, SR22 and SR23. The thermal head 5 is urged against the platen through the paper, and the next color overlaps the previous color in steps SR24 and SR25. The main controller 191 detects in step SR26 whether or not printing with all specified colors is completed. If NO in step SR26, steps SR21 to SR26 are repeated. When the main controller 191 detects that printing with all specified colors is completed, the paper roll Pc is discharged into a discharge tray (not shown) in step SR27.

The above describes a multi-color printing operation. However, one-color printing can be achieved in the same manner, except that the paper roll is discharged when first color printing is completed. Multi- or one-color printing is controlled in accordance with the detected thermal transfer ribbon type and color designation signals.

According to the present invention as described in detail above, there is provided a printing apparatus with good operability and good performance, wherein the type of transfer material is automatically detected to change the printing mode, and a one- or multi-color transfer material is used to perform one- or multi-color printing.

What is claimed is:

1. A thermal transfer color printer with printing mode control, comprising:

a transfer medium;

first feeding means for setting and feeding said transfer medium to a first passage including a predetermined transfer position;

a plurality of thermal transfer materials, each one of said plurality of thermal transfer materials having a thermal transfer agent of at least one monochromatic color provided beforehand, and discriminating data, which are peculiar to each thermal transfer material and each color agent coresponding to each thermal transfer material, said discriminating data being provided along a longitudinal direction of at least one end of the wide direction of each thermal transfer material;

second feeding means for selecting among said plurality of thermal transfer materials and feeding the selected thermal transfer material to a second passage including a predetermined transfer position;

printing data output means for outputting printing data;

thermal transferring means, including a thermal print head selectively driven, for thermally transferring the color agent of said thermal transfer material, which is fed by said second feeding means, on said thermal transfer medium, which is fed at said predetermined transfer position by said feeding means, according to said printing data by said thermal print head;

detecting means for detecting the discriminating data, which is provided on said thermal transfer material, at the front side of said predetermined transfer position on said second passage and outputting the corresponding detected data;

determining means for determining the kind of said thermal transfer material by comparing the detected data from said detecting means with the characteristic reference data corresponding to each thermal transfer material provided beforehand; and controlling means for outputting a printing mode control signal, which corresponds ot the result of the determination by said determining means, to at least said thermal transfer means.

2. A thermal transfer color printer with printing mode control according to claim 1, wherein said thermal transfer material has a thermal transfer agent of monochromatic color and said controlling means further outputs a printing mode control signal, which corresponds to the result of the determination by said determining means, to said second feeding means.

3. A thermal transfer color printer with printing mode control according to claim 1, wherein said thermal transfer material has a thermal transfer agent of a plurality of colors and said controlling means further outputs a printing mode control signal, which corresponds to the result of the determination by said determining means, to said first and second feeding means.

4. A thermal transfer color printer with printing mode control according to claim 2, wherein said printing mode control signal includes a signal for feeding said thermal transfer material having said thermal transfer agent of monochromatic color in a unit distance corresponding to one page of said transfer medium by said second feeding means.

5. A thermal transfer color printer with printing mode control according to claim 3, wherein said printing mode control signal includes a first signal for feeding said thermal transfer material having said thermal transfer agents of a plurality of colors to every unit of each color agent by said second feeding means and a second signal for moving said transfer medium to the front and rear of the transfer position in a unit distance corresponding to said unit of each color agent by said first feeding means.

6. A thermal transfer color printer with printing mode control according to claim 5, wherein said thermal transfer agent of a plurality of colors has two colors.

7. A thermal transfer printer with printing mode control according to claim 5, wherein said thermal transfer agent of a plurality of colors has three colors.

8. A thermal transfer color printer with printing mode control according to claim 5, wherein said thermal transfer agent of a plurality of colors has four colors.

* * * * *